US005681217A

United States Patent [19]

Hoopman et al.

[11] Patent Number: 5,681,217

[45] Date of Patent: Oct. 28, 1997

[54] ABRASIVE ARTICLE, A METHOD OF MAKING SAME, AND A METHOD OF USING SAME FOR FINISHING

[75] Inventors: Timothy L. Hoopman, River Falls, Wis.; Scott R. Culler, Burnsville, Minn.

[73] Assignee: Minnesota Mining and Manufacturing Company, St. Paul, Minn.

[21] Appl. No.: 678,366

[22] Filed: Jul. 17, 1996

Related U.S. Application Data

[63] Continuation of Ser. No. 200,063, Feb. 22, 1994, abandoned.

[51] Int. Cl.[6] ..... B24D 11/00

[52] U.S. Cl. ..... 451/528; 451/526; 451/527

[58] Field of Search ..... 51/293; 451/526, 451/527, 528, 529, 530, 921, 539

[56] References Cited

U.S. PATENT DOCUMENTS

| | | | |
|---|---|---|---|
| Re. 29,808 | 10/1978 | Wagner | 51/401 |
| 1,941,962 | 1/1934 | Tone | 91/67.9 |
| 1,988,065 | 1/1935 | Wooddell | 91/68 |

(List continued on next page.)

FOREIGN PATENT DOCUMENTS

| | | |
|---|---|---|
| 2009718 | 8/1990 | Canada . |
| 004454 A3 | 10/1979 | European Pat. Off. . |
| 109851 B1 | 5/1984 | European Pat. Off. . |
| 168065 A1 | 1/1986 | European Pat. Off. . |
| 306161 A2 | 3/1989 | European Pat. Off. . |
| 306162 A2 | 3/1989 | European Pat. Off. . |
| 345239 A1 | 12/1989 | European Pat. Off. . |
| 429269 A1 | 5/1991 | European Pat. Off. . |
| 554668 A1 | 8/1993 | European Pat. Off. . |
| 650803 A1 | 5/1995 | European Pat. Off. . |
| 650807 A1 | 5/1995 | European Pat. Off. . |
| 881239 | 4/1943 | France . |
| 2354373 | 1/1978 | France . |
| 57-121458 | 7/1982 | Japan . |
| 58-196974 | 11/1983 | Japan . |

(List continued on next page.)

OTHER PUBLICATIONS

"Irgacure® 369" Brochure of Ciba–Geigy Corp., 1993.

*Encyclopedia of Polymer Science and Technology*, vol. 8; John Wiley: New York; pp. 661–665 (1968).

J.V. Crivello, "Photoinitiated Cationic Polymerization", *Ann. Rev. mater. Sci.*, 13, 173–190 (1983).

K.L. Wilke et al., "Coated Abrasive Superfinishing: Predictable, Repeatable Texturing of Metal Roll Surfaces", from 3M Industrial Abrasives Division, Doc. No. A–ARLSF(92.05)BPH, May 1992 (8 pages).

"Gem Centerless Microfinishers", Brochure of Grinding Equipment & Machinery Co., Inc., Youngstown, OH (published before Jan. 1, 1990).

"Superfinishing: The Microfinishing Systems Way", Brochure of 3M Microfinishing Systems, 6 pgs. (Jul. 14, 1988).

*Kirk–Othmer Encyclopedia of Chemical Technology, Third Edition*, vol. 1; John Wiley: New York; pp. 35–37 (1978).

V.A. Morozov, "How the Surface Relief of Abrasive Belts Affects Efficiency in Grinding Jobs", *Soviet Engineering Resarch*, 9, 103–107 (1989).

*Primary Examiner*—James G. Smith

*Assistant Examiner*—Derris H. Banks

*Attorney, Agent, or Firm*—Gary L. Griswold; Walter N. Kirn; Paul W. Busse

[57] ABSTRACT

An abrasive article having sheet-like structure including a major surface extending within an imaginary plane with a plurality of individual three-dimensional abrasive composites deployed in fixed positions thereto in an array, each of the composites has abrasive particles dispersed in a binder and has a substantially precise shape and a distal end, where another imaginary plane extends parallel to and is spaced from the first imaginary plane and intersects the lowest distal end among the composites, wherein any imaginary line drawn within the latter-mentioned imaginary plane in the direction(s) of intended use intersect at least one cross-section among the abrasive composites in the array. The invention also relates to methods for manufacturing such an abrasive article and its usage to refine a work surface.

16 Claims, 5 Drawing Sheets

U.S. PATENT DOCUMENTS

| | | | |
|---|---|---|---|
| 2,001,911 | 5/1935 | Wooddell et al. | 51/190 |
| 2,015,658 | 10/1935 | Bezzenberger | 51/278 |
| 2,108,645 | 2/1938 | Bryant | 91/68 |
| 2,115,897 | 5/1938 | Wooddell et al. | 51/188 |
| 2,242,877 | 5/1941 | Albertson | 51/293 |
| 2,252,683 | 8/1941 | Albertson | 51/293 |
| 2,347,244 | 4/1944 | Colt et al. | 51/294 |
| 2,755,607 | 7/1956 | Haywood | 51/185 |
| 2,806,772 | 9/1957 | Robie | 51/296 |
| 2,876,086 | 3/1959 | Raymond | 51/298 |
| 2,907,146 | 10/1959 | Dyar | 451/921 |
| 3,048,482 | 8/1962 | Hurst | 51/298 |
| 3,057,256 | 10/1962 | Erban | 88/28.93 |
| 3,211,634 | 10/1965 | Lorenzo | 204/16 |
| 3,517,466 | 6/1970 | Bouvier | 51/358 |
| 3,549,341 | 12/1970 | Kittredge et al. | 51/293 |
| 3,594,865 | 7/1971 | Erb | 18/5 |
| 3,605,349 | 9/1971 | Antholn | 51/402 |
| 3,615,302 | 10/1971 | Rowse et al. | 51/295 |
| 3,631,638 | 1/1972 | Yoshikawa | 51/295 |
| 3,641,719 | 2/1972 | Yang | 51/402 |
| 3,661,544 | 5/1972 | Whitaker | 51/925 |
| 3,689,346 | 9/1972 | Rowland | 186/245 |
| 3,833,703 | 9/1974 | Joos | 264/167 |
| 3,859,407 | 1/1975 | Blanding et al. | 264/62 |
| 3,991,527 | 11/1976 | Maran | 51/397 |
| 4,011,358 | 3/1977 | Roelofs | 428/287 |
| 4,038,047 | 7/1977 | Haywood | 51/295 |
| 4,055,029 | 10/1977 | Kalbow | 51/395 |
| 4,106,915 | 8/1978 | Kagawa et al. | 51/296 |
| 4,311,489 | 1/1982 | Kressner | 51/298 |
| 4,314,827 | 2/1982 | Leitheiser et al. | 51/298 |
| 4,318,766 | 3/1982 | Smith | 156/330 |
| 4,364,746 | 12/1982 | Bitzer et al. | 51/298 |
| 4,420,527 | 12/1983 | Conley | 428/172 |
| 4,456,500 | 6/1984 | Ibeta | 156/634 |
| 4,539,017 | 9/1985 | Augustin | 51/293 |
| 4,553,982 | 11/1985 | Korbel et al. | 51/298 |
| 4,576,850 | 3/1986 | Martens | 428/156 |
| 4,587,291 | 5/1986 | Gardziella et al. | 524/595 |
| 4,588,258 | 5/1986 | Hoopman | 350/103 |
| 4,588,419 | 5/1986 | Caul et al. | 51/295 |
| 4,623,364 | 11/1986 | Cottringer et al. | 51/309 |
| 4,644,703 | 2/1987 | Kaczmarek et al. | 51/401 |
| 4,652,274 | 3/1987 | Boettcher et al. | 51/298 |
| 4,652,275 | 3/1987 | Bloecher et al. | 51/298 |
| 4,735,632 | 4/1988 | Oxman et al. | 51/295 |
| 4,744,802 | 5/1988 | Schwabel | 51/309 |
| 4,751,138 | 6/1988 | Tumey et al. | 428/323 |
| 4,770,671 | 9/1988 | Monroe et al. | 51/293 |
| 4,773,920 | 9/1988 | Chasman et al. | 51/295 |
| 4,799,939 | 1/1989 | Bloecher et al. | 51/293 |
| 4,875,259 | 10/1989 | Appledorn | 24/576 |
| 4,881,951 | 11/1989 | Wood et al. | 51/309 |
| 4,903,440 | 2/1990 | Larson et al. | 51/298 |
| 4,930,266 | 6/1990 | Calhoun et al. | 51/293 |
| 4,950,696 | 8/1990 | Palazotto et al. | 522/25 |
| 4,952,612 | 8/1990 | Brown-Wensley et al. | 522/25 |
| 4,959,265 | 9/1990 | Wood et al. | 429/343 |
| 4,983,458 | 1/1991 | Dejaiffe | 428/402 |
| 4,985,340 | 1/1991 | Palazzotto et al. | 430/270 |
| 4,997,461 | 3/1991 | Markhoff-Matheny et al. | 51/295 |
| 5,011,508 | 4/1991 | Wald et al. | 51/293 |
| 5,011,513 | 4/1991 | Zador et al. | 51/295 |
| 5,014,468 | 5/1991 | Ravipati et al. | 51/295 |
| 5,015,266 | 5/1991 | Yamamoto | 51/293 |
| 5,022,895 | 6/1991 | Wiand | 51/295 |
| 5,039,311 | 8/1991 | Bloecher | 51/295 |
| 5,061,294 | 10/1991 | Harmer et al. | 51/295 |
| 5,077,870 | 1/1992 | Melbye et al. | 24/452 |
| 5,078,753 | 1/1992 | Broberg et al. | 51/298 |
| 5,086,086 | 2/1992 | Brown-Wensley et al. | 522/25 |
| 5,090,968 | 2/1992 | Pellow | 51/293 |
| 5,093,180 | 3/1992 | Morgan | 428/156 |
| 5,107,626 | 4/1992 | Mucci | 51/293 X |
| 5,131,926 | 7/1992 | Rostoker et al. | 51/309 |
| 5,137,542 | 8/1992 | Buchanan et al. | 51/295 |
| 5,147,900 | 9/1992 | Palazzotto et al. | 522/25 |
| 5,152,917 | 10/1992 | Pieper et al. | 51/295 |
| 5,174,795 | 12/1992 | Wiand | 51/295 |
| 5,178,646 | 1/1993 | Barber, Jr. et al. | 51/298 |
| 5,199,227 | 4/1993 | Ohishi | 51/293 |
| 5,201,101 | 4/1993 | Rouser et al. | 24/575 |
| 5,201,916 | 4/1993 | Berg et al. | 51/293 |
| 5,203,884 | 4/1993 | Buchanan et al. | 51/295 |
| 5,219,462 | 6/1993 | Bruxvoort et al. | 51/293 |
| 5,236,472 | 8/1993 | Kirk et al. | 51/298 |
| 5,273,805 | 12/1993 | Calhoun et al. | 428/156 |
| 5,304,223 | 4/1994 | Pieper et al. | 51/293 |
| 5,316,812 | 5/1994 | Stout et al. | 428/64 |
| 5,318,604 | 6/1994 | Gorsuch et al. | 51/293 |
| 5,368,619 | 11/1994 | Culler | 51/308 |
| 5,378,251 | 1/1995 | Culler et al. | 51/295 |
| 5,435,816 | 7/1995 | Spurgeon et al. | 51/295 |
| 5,437,754 | 8/1995 | Calhoun | 156/231 |
| 5,453,312 | 9/1995 | Haas et al. | 428/143 |
| 5,454,844 | 10/1995 | Hibbard et al. | 51/295 |
| 5,489,235 | 2/1996 | Gagliardi et al. | 451/527 |
| 5,527,368 | 6/1996 | Supkis et al. | 51/298 |

FOREIGN PATENT DOCUMENTS

| | | | |
|---|---|---|---|
| 60-9663 | 1/1985 | Japan . | |
| 61-244468 | 10/1986 | Japan . | |
| 62-255069 | 11/1987 | Japan . | |
| 63-235942 | 9/1988 | Japan . | |
| 2-83172 | 3/1990 | Japan . | |
| 4-159084 | 6/1992 | Japan . | |
| 6-190737 | 7/1994 | Japan . | |
| 749650 | 7/1980 | U.S.S.R. . | |
| 975375 | 11/1982 | U.S.S.R. . | |
| 0996178 | 2/1983 | U.S.S.R. | 451/527 |
| 1316805 | 6/1987 | U.S.S.R. . | |
| 1005448 | 9/1965 | United Kingdom . | |
| 2043501 A | 10/1980 | United Kingdom . | |
| 2094824 A | 9/1982 | United Kingdom . | |
| WO92/15626 | 9/1992 | WIPO . | |
| WO93/12911 | 7/1993 | WIPO . | |
| WO93/13912 | 7/1993 | WIPO . | |
| WO94/20264 | 9/1994 | WIPO . | |
| WO94/27780 | 12/1994 | WIPO . | |

ABRASIVE ARTICLE, A METHOD OF MAKING SAME, AND A METHOD OF USING SAME FOR FINISHING

This is a continuation of application Ser. No. 08/200,063, filed Feb. 22, 1994 now abandoned.

BACKGROUND OF THE INVENTION

1. Field of the Invention

This invention relates to an abrasive article having a sheet-like structure having a major surface having deployed thereon a plurality of abrasive composites having precise shapes which are positioned on the major surface in a prescribed pattern. The invention also relates to methods of making same and using such an abrasive article to reduce a surface finish.

2. Description of the Related Art

In general, abrasive articles employ a plurality of abrasive particles which are bonded together as a unitary structure (e.g., a grinding wheel) or bonded separately to a common backing (e.g., a coated abrasive article). While these types of abrasive articles have been utilized to abrade and finish workpieces for many years, problems remain in the field.

For instance, one persistent problem confronting the abrasive industry arises from the generally inverse relationship associated between the cut rate (i.e., the amount of workpiece removed for a given time interval) and the finish that is imparted by the abrasive article on the workpiece surface. That is, it is difficult to design an abrasive article that affords a relatively high rate of cut while concomitantly imparting a relatively fine surface finish on the workpiece being abraded. This explains the presence of a wide range of abrasive products in the market using coarse grit (i.e., relatively large particle size of abrasive particles) to fine grit (i.e., relatively small particle size of abrasive particles). The use of these differently grit-sized abrasive products in a separate and sequential manner can provide some measure of success in ultimately achieving both a high cut and a fine finish, but the practice can be cumbersome and time consuming. Naturally, a single abrasive article which simultaneously would provide both high cut rate and fine finish would be more convenient and highly desired in the industry.

In addition to these goals, it has also been desired in the abrasive industry to provide an abrasive article which imparts a consistent surface finish in the workpiece while lessening or preventing scribing. Scribing refers to the occurrence of pronounced unwanted grooves in the workpiece surface which results in an increase in surface roughness units (Ra). In many instances, scribing is not desired. Ra is the arithmetic average of the scratch depth. Typically, the grooves, when they occur, extend in the surface of the workpiece in a direction tracking the relative motion of the abrasive article vis-à-vis the workpiece surface.

More specifically, U.S. Pat. No. 2,115,897 (Wooddell et al.) teaches an abrasive article having a backing and attached thereto by an adhesive are a plurality of blocks of bonded abrasive material. These bonded abrasive blocks can be adhesively secured to the backing in a specified pattern.

U.S. Pat. No. 2,242,877 (Albertson) teaches a method of making a compressed abrasive disc. The method involves embedding abrasive particles in a binder layer that is coated on a fibrous backing. Then, a mold die is used to impart a molded pattern or contour into the thickness of binder and particle layer under heat and pressure to form a compressed abrasive disc. The molded surface of the abrasive disc has a specified working surface pattern which is the inverse of the profile of the molding die.

U.S. Pat. No. 2,755,607 (Haywood) teaches a coated abrasive in which there are land and groove abrasive portions, which can form, for example, an overall rectlinear or serpentine pattern. An adhesive coat is applied to the front surface of a backing and this adhesive coat is then combed to create peaks and valleys to pattern the surface of the adhesive coat. Haywood discloses that each of the lands and grooves formed in the adhesive coat by such a combing procedure preferably have the same width and thickness, but that they may be varied. Next the abrasive grains are distributed uniformly in the lands and grooves of the previously patterned adhesive coat followed by solidification of the adhesive coat. The abrasive particles used in Haywood are individual grains which are not used in slurry form with other grains in a binder. Therefore, the individual abrasive grains have irregular non-precise shapes.

U.S. Pat. No. 3,048,482 (Hurst) discloses an abrasive article comprising a backing, a bond system and abrasive granules that are secured to the backing by the bond system. The abrasive granules are a composite of abrasive grains and a binder which is separate from the bond system. The abrasive granules are three dimensional and are preferably pyramidal in shape. To make this abrasive article, the abrasive granules are first made via a molding process. Next, a backing is placed in a mold, followed by the bond system and the abrasive granules. The mold has patternized cavities therein which results in the abrasive granules having a specified pattern on the backing.

U.S. Pat. No. 3,605,349 (Anthon) pertains to a lapping type abrasive article. The binder and the abrasive grain are mixed together and then sprayed onto the backing through a grid. The presence of the grid results in a patterned abrasive coating.

Great Britain Patent Application No. 2,094,824 (Moore) pertains to a patterned lapping film. The abrasive slurry is prepared and the slurry is applied through a mask to form discrete islands. Next, the resin or binder is cured. The mask can be a silk screen, stencil, wire, or a mesh.

U.S. Pat. No. 4,644,703 (Kaczmarek et al.) concerns a lapping abrasive article comprising a backing and an abrasive coating adhered to the backing. The abrasive coating further comprises a suspension of lapping size abrasive grains and a binder cured by free radical polymerization. The abrasive coating can be shaped into a pattern by a rotogravure roll.

U.S. Pat. No. 4,773,920 (Chasman et al.) concerns a lapping abrasive article comprising a backing and an abrasive coating adhered to the backing. The abrasive coating comprises a suspension of lapping size abrasive grains and a binder cured by free radical polymerization. The abrasive coating can be shaped into a pattern by a rotogravure roll.

U.S. Pat. No. 4,930,266 (Calhoun et al.) teaches a patterned abrasive sheeting in which the abrasive granules are strongly bonded and lie substantially in a plane at a predetermined lateral spacing. In this invention the abrasive granules are applied via a impingement technique so that each granule is essentially individually applied to the abrasive backing. This results in an abrasive sheeting having a precisely controlled spacing of the abrasive granules.

U.S. Pat. No. 5,014,468 (Ravipati et al.) pertains to a lapping film intended for ophthalmic applications. The lapping film comprises a patterned surface coating of abrasive grains dispersed in a radiation cured adhesive binder. The patterned surface coating has a plurality of discrete raised three dimensional formations having widths which diminish in the direction away from the backing. To make the patterned surface, an abrasive slurry is applied to a rotogravure roll to provide a shapes surface which is then removed from the roll surface and then the radiation curable resin is cured.

U.S. Pat. No. 5,015,266 (Yamamoto) pertains to an abrasive sheet by uniformly coating an abrasive adhesive slurry over an embossed sheet. The resulting abrasive coating has high and low abrasive portions formed by the surface tension of the slurry, corresponding to the irregularities of the base sheet.

U.S. Pat. No. 5,107,626 (Mucci) teaches a method of providing a patterned surface on a substrate by abrading with a coated abrasive containing a plurality of precisely shaped abrasive composites. The abrasive composites are in a non-random array and the abrasive composites comprise a plurality of abrasive grains dispersed in a binder.

U.S. Pat. No. 5,152,917 (Pieper et al.) discloses a coated abrasive article that provides both a relatively high rate of cut and a relatively fine surface finish on the workpiece surface. The structured abrasive of Pieper et al. involves precisely shaped abrasive composites that are bonded to a backing in a regular nonrandom pattern. The consistency of the profile of the abrasive composites provided by the abrasive structure of Pieper et al., among other things, helps provide a consistent surface finish in the worked surface.

Japanese Laid-Open Patent Application No. 63-235942 published Mar. 23, 1990 teaches a method of a making a lapping film having a specified pattern. An abrasive slurry is coated into a network of indentations in a tool. A backing is then applied over the tool and the binder in the abrasive slurry is cured. Next, the resulting coated abrasive is removed from the tool. The binder can be cured by radiation energy or thermal energy.

Japanese Laid-Open Patent Application No. 4-159084 published Jun. 2, 1992 teaches a method of making a lapping tape. An abrasive slurry comprising abrasive grains and an electron beam curable resin is applied to the surface of an intaglio roll or indentation plate having a network of indentations. Then, the abrasive slurry is exposed to an electron beam which cures the binder and the resulting lapping tape is removed from the roll.

U.S. Pat. No. 5,437,754 (Calhoun) teaches a method of making an abrasive article. An abrasive slurry is coated into recesses of an embossed substrate. The resulting construction is laminated to a backing and the binder in the abrasive slurry is cured. The embossed substrate is removed and the abrasive slurry adheres to the backing.

U.S. Pat. No. 5,219,462 (Bruxvoort et al.) teaches a method for making an abrasive article. An abrasive slurry is coated substantially only into the recesses of an embossed backing. The abrasive slurry comprises a binder, abrasive grains and an expanding agent. After coating, the binder is cured and the expanding agent is activated. This causes the slurry to expand above the surface of the embossed backing. The lateral spacing between precisley spaced individual abrasive composites is not necessarily the same, but are spaced as desired for the particular application. For instance, Bruxvoort et al. exemplifies this type of arrangement as being a disc application, where there is described a progressively higher density of abrasive composites as one proceeds radially from the center of the disc.

U.S. Pat. No. 5,435,816 (Spurgeon et al.) teaches a method of making an abrasive article. In one aspect of this patent application, an abrasive slurry is coated into recesses of an embossed substrate. Radiation energy is transmitted through the embossed substrate and into the abrasive slurry to cure the binder.

U.S. patent application Ser. No. 08/067,708 filed 26 May 1993 (Mucci et al.), which is commonly assigned to the owner of the present application, teaches a method of polishing a workpiece with a structured abrasive. The structured abrasive comprises a plurality of precisely shaped abrasive composites bonded to a backing. During polishing, the structured abrasive oscillates.

Although some of the abrasive articles made according to the aforementioned patents, viz. Pieper et al., might provide an abrasive article yielding both high rate of cut and relatively fine finish, it has been observed that scribing can occur in surfaces worked by some prior art abrasive articles when the abrasive articles are used. For instance, many abrasive articles have directional limitations insofar as how the articles are to be oriented relative to the work surface to be reduced, i.e., some articles cannot be used omnidirectionally. If used improperly by accident or neglect, e.g., if such an abrasive article is not properly aligned with the surface to be worked by the operator, these abrasive articles, among other things, can cause scribing in the worked surface.

U.S. patent application Ser. No. 08/120,300 filed 13 Sep. 1993 (Hoopman et al.) describes one successful approach to solving the scribing problem in terms of providing precisely-shaped abrasive composites, such as pyramidal shapes, in an array in which the shapes are not all identical and the spacing is not identical along the distal ends of the composites.

U.S. patent application Ser. No. 08/120,297 (Gagliardi et al.) describes a coated abrasive article with ridges of abrasive material arranged at a nonzero angle to the machine direction, which produces a helical pattern.

While the above-mentioned Hoopman et al. and Gagliardi et al. innovations represent effective solutions to scribing, it can be understood that the abrasive industry would be interested in considering other alternate proposals for providing a versatile high-cut rate, fine finish abrasive article which is resistant to inadvertent scribing and adaptable to a wider range of abrasive conditions.

SUMMARY OF THE INVENTION

The present invention provides an abrasive article which has a high cut rate yet imparts a relatively fine surface finish without scribing the workpiece. In general, the invention pertains to an abrasive article having sheet-like structure including a major surface extending within an imaginary plane with a plurality of individual three-dimensional abrasive composites deployed in fixed positions thereto in an array, each of the composites comprise abrasive particles dispersed in a binder and have a substantially precise shape and a distal end, where another imaginary plane extends parallel to and is spaced from the first imaginary plane and intersects the lowest distal end(s) among the composites, wherein traces of any imaginary line drawn within the latter-mentioned imaginary plane in the direction(s) of intended use intersect at least one cross-section among the abrasive composites in the array lying in the latter-mentioned imaginary plane.

For purposes of this invention, the following terms have the meaning as indicated:

"imaginary line" is a line extending indefinitely in the either direction of extent of the line;

"intersects" means a line or plane touches a cross-section of the composite. This "cross-section" will essentially be a point if the intersection occurs at a distal end or outermost terminus of an abrasive composite. For example, if the plane parallel to the major surface slices the composites at their outermost height, such as the outer end of rounded or conical portions, the plane will be virtually tangential to the distal end and the intersection therewith will be a cross-section that is essentially a point. An imaginary line also intersects such a distal end at such a point. Alternatively, the term "intersects" also means an imaginary line touching a cross-sectional slice of an abrasive composite having more significant two-dimensional surface area in the sense that, in a plan top view of the abrasive article, the traces of the line at least touch the perimeter of the outer profile of a cross-sectional slice cut by the plane parallel to the major surface plane, such as in a tangential manner thereto, or the line extends across the perimeter of the cross-section at a first location to enter and cross an interior area of the cross-section and departs therefrom at a second location along the perimeter;

"precise-shape", and the like, as used herein in describing the abrasive composites, refers to abrasive composites having a shape that has been formed by curing the curable binder of a flowable mixture of abrasive particles and curable binder while the mixture is both being borne on a backing and filling a cavity on the surface of a production tool to provide a "precise shape" in the abrasive composite formed. Thus, the "precise shape" of the abrasive composite has essentially the same geometrical shape as the cavity from which it is formed. Further, the precise shape of the abrasive composite is defined by relatively smooth-surfaced sides. As small bubble recesses may occur in the outer surface areas of the composite shapes during fabrication, the shapes may be "substantially" precise in some instances; although the overall three-dimensional shape of the composites are still clearly discernible despite these slight imperfections, if occuring;

"boundary", as used herein to define the abrasive composites, means the exposed surfaces and edges of each abrasive composite that delimit and define the actual three-dimensional shape of each abrasive composite.

These distinct and discernible boundaries are readily visible and clear when a cross-section of the abrasive article of the invention is examined under a microscope such as a scanning electron microscope. The distinct and discernible boundaries of each abrasive composite form the cross-sectional outlines and contours of the precise shapes of the present invention. These boundaries separate and distinguish one individual abrasive composite from another. By comparison, in an abrasive composite that does not have a precise shape, the boundaries and edges are not definitive, e.g., where the abrasive composite sags before completion of its curing;

"dimension", as used in connection with defining the abrasive composites, means a measure of spatial extent such as an edge length of a side surface or height of the shape associated with an abrasive composite or, alternatively, the "dimension" can mean a measure of an angle of inclination of a side surface extending from the backing;

"geometrical shape" means a three-dimensional geometrical shape;

"rounded", as used to define a geometry of the shape of the abrasive composites or a portion thereof, means a three-dimensional dome-like or hemispherical shape; and "adjacent composite" or "adjacent composites", or the like, means at least two neighboring composites which lack any intervening abrasive composite structure located on a direct line therebetween.

In one embodiment of the invention, where the abrasive article of the invention is intended for usage as an endless belt form intended primarily for one basic direction of motion, i.e., a machine direction, it is enough to prevent scribing where the composites are so arranged to preclude the ability to draw any imaginary line in the machine direction of the belt in a plane parallel to the major surface of the abrasive article that intersects the distal end nearest the major surface among the composites, which does not intersect at least one cross-section of any abrasive composite among the array lying in such a plane. This embodiment of the invention is also contemplated for discrete sheet forms of the abrasive article.

On the other hand, it is expected that there would be instances where the nonscribing abrasive article of the invention is contemplated for multidirectional usage capability where there should be no restrictions on the orientation of the composite array vis-à-vis the work surface in any of a contemplated plurality of machine directions. Accordingly, in another embodiment of the invention, the abrasive composites are arbitrarily positioned to provide the ability to draw imaginary lines in any of a plurality of intended machine directions within a plane extending parallel to the major surface of the abrasive article that intersects the distal end nearest the major surface among the composites, which will intersect at least one cross-section of any abrasive composite among the array in such a plane. The latter embodiment is especially needed and convenient in the use of abrasive articles presented in discrete (nonendless) sheet form where it may represent a great nuisance to the operator if fastidious care would be required to orient the array of composites borne on an abrasive article in a specific limited manner relative to the workpiece before and during frictional engagement therebetween. However, this embodiment is also applicable to a belt form of the abrasive article.

In one further embodiment of the abrasive article of the invention, the individual abrasive composites have a geometrical shape selected from the group of geometrical shapes consisting of a frusto-conical shape (truncated cone), a frusto-conical shape (truncated cone) terminating at its distal end in a rounded or dome shape, a frusto-conical shape (truncated cone) terminating at its distal end in a second smaller conical shape, cubic, prismatic, conical, cylindrical, dogbone, pyramidal, and truncated pyramidal.

One useful composite shape is a complex shape having two basic portions including: (1) a frusto-conical shape portion, which is attached to and projects outwardly from the major surface of the abrasive article, and (2) another portion that is a rounded or hemispherical shape located at the outer end of the composite member on top of the frusto-conical portion. By "frusto-conical", it is meant a frustum shape as a truncated part of a conical solid defined between two parallel planes cutting the solid, viz. the section between the base of the composite shape in contact with the major surface of the abrasive article and a plane parallel to the base. Generally, the two cutting planes are perpendicular to the central axis of the cone; although some slight tilt of these planes is also contemplated to form a tilted truncated cone structure. Also, the cross-sections of the truncated cone can be circular or elliptical. The rounded shape can be contoured convexly outwardly from the bulk of the frusto-conical portion of the composite or, alternatively, concaved towards the base into the bulk of the frusto-conical portion.

It has been discovered that the force per unit area and hence cut rate is more uniformly maintained after such rounded tips start to wear and the frusto-conical portion of the abrasive composites become the working surfaces. The frusto-conical shape is thought to experience a decreased rate of change in force per unit area during grinding due to the relatively steep inclining sidewalls forming the shape of the composites, such as truncated cones. The provision of an abrasive article employing the complex abrasive composite shapes having a frusto-conical portion and a rounded tip or distal end is considered to represent another embodiment of the invention.

Also, the individual shapes of the abrasive composites can be so grouped together in subarrays where each such subarray of composites prevents the ability to to draw imaginary lines in any intended machine direction(s) within a plane extending parallel to the major surface of the abrasive article that intersects the distal end nearest the major surface among the composites in each subarray, which will intersect at least one cross-section of any abrasive composite in the given subarray in such a plane. By replicating these subarrays across the entirety of the major surface of the abrasive article, the requirements of the invention can be satisfied without the necessity of arbitrarily fixing the location of every individual composite in the array over the entire abrasive article. This approach provides a pseudo-random technique for achieving the objectives of the invention. However, the various subarrays must be arranged in proximity to each other so as not to leave rectilinear pathways between the different subarrays that extend in the direction (s) of use intended for the abrasive article. Mosaic patterns are preferred where each subarray of composites defines an area having a perimeter and the respective areas of adjacent subarrays can be inset or overlap somewhat relative to each other. As a consequence, no clear pathways are created in the direction of intended usage between adjacent subarrays arranged in this manner.

For instance, herring bone, cross-hatched, and dogbone subarray arrangements of the abrasive composites can be used in this regard. A "herring bone" pattern comprises rows of short, slanted parallel lines of abrasive composite material as seen in a plan view, with the direction of the slant alternating row by row. A "cross-hatched" pattern has subsets of several parallel lines of abrasive composite material as seen in a plan view which closely approach perpendicularly but do not touch other such subsets. A "dogbone" pattern comprises individual members of abrasive composite material where each are generally rectangular along its longitudinal axis but having enlarged ends as seen in a plan view, where these members are arranged perpendicularly in close noncontacting proximity to each other in the pattern. Further, the herring bone, cross-hatched, and dogbone arrangements can be formed by appropriately locating together individual composites each having upstanding shapes from the major surface of the abrasive article, with or without rounded tips or end portions.

In another further embodiment of the abrasive article of the present invention, each abrasive composite has a distal end (outermost terminal end) spaced from the base surface and each distal end extends to substantially the same distance to the same imaginary plane which is spaced from and parallel to the base surface. For example, in one embodiment, the abrasive composites have the same height value measured from the base surface to distal end in a range of from about 50 micrometers to about 1020 micrometers.

In yet another further embodiment of the abrasive article of the invention, abrasive composites are fixed on the major surface in a density of about 100 to about 10,000 abrasive composites/$cm^2$.

In another embodiment of the invention there is a method for making the aforesaid abrasive article of the invention comprising the steps of:

(a) preparing an abrasive slurry wherein the abrasive slurry comprises a plurality of abrasive particles dispersed in a binder precursor;

(b) providing (i) a backing having a front major surface with a machine direction axis and a pair of opposite side edges, each of the side edges being parallel to the machine direction axis and each side edge being respectively within a second and third imaginary plane each of which extends perpendicular to the front surface, and (ii) a production tool having a major surface bounded by parallel opposing side edges and a plurality of cavities each defined by a walled recess having an opening at the major surface, wherein each cavity comprises a precise shape defined by distinct and discernible boundaries which include specific dimensions, whereby any imaginary line drawn to traverse said major surface in a direction parallel to the opposing side edges of the production tool intersects at least one cavity opening among the cavities of the array;

(c) providing a means to apply the abrasive slurry into a plurality of the cavities of the production tool;

(d) contacting the front major surface of the backing with the production tool such that the abrasive slurry wets the front major surface of the backing;

(e) solidifying the binder precursor to form a binder, whereupon solidification the abrasive slurry is converted into a plurality of abrasive composites bonded to the backing; and (f) separating the production tool from the front major surface after solidifying to provide a plurality of individual three-dimensional abrasive composites attached in an array to the front major surface, where the composites are so arranged to preclude the ability to draw any imaginary line in the machine direction of the article in a plane parallel to the major surface of the abrasive article that intersects the composite distal end(s) nearest the major surface among the composites, which does not intersect at least one cross-section of any abrasive composite among the array lying in such a plane.

In another embodiment of the invention, the abrasive article described herein is used in a method to reduce the surface of a workpiece, having the steps of:

(a) bringing into frictional contact a workpiece surface and one of the aforesaid abrasive articles of the invention; and (b) moving at least one of the abrasive article or the workpiece surface relative to the other such that the surface finish of the workpiece surface is reduced.

Other features, advantages, and constructions of the invention will be better understood from the following description of figures and the preferred embodiments of the present invention.

DESCRIPTION OF THE PREFERRED EMBODIMENTS

The abrasive article of the invention exhibits a high rate of cut while imparting a relatively level, fine surface finish on the workpiece being abraded and does not readily scribe the workpiece. In the present invention, it is believed that the variation in the spacing between adjacent precisely-shaped abrasive composites disrupts and/or prevents vibrational resonance from developing to thus provide a high cut-rate, fine finish with decreased chatter incidence in addition to decreased scribing.

Figure 1:
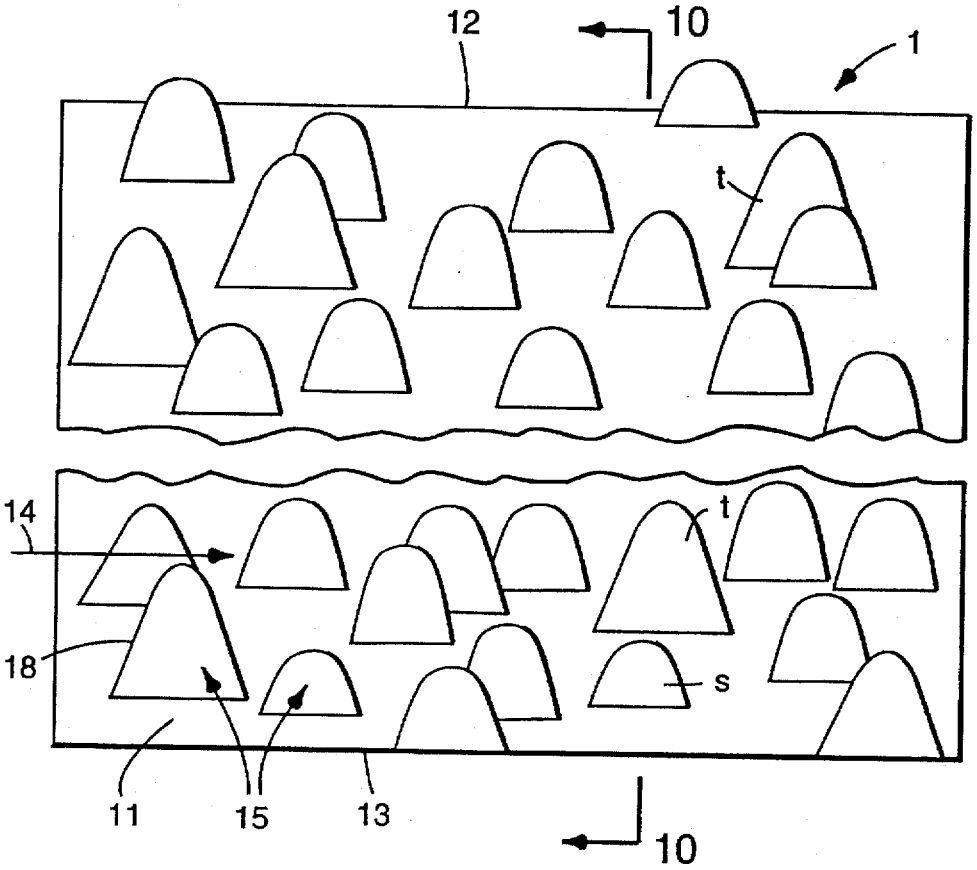
FIG. 1 is an enlarged perspective top view representing one embodiment of an abrasive article of this invention.

Referring to FIG. 1, an illustrative top perspective view is shown of an abrasive article 1 of the invention of the embodiment where the abrasive composites are so arranged in the array to preclude the ability to draw any imaginary line in the machine direction of the article within a plane extending parallel to the major surface of the abrasive article that intersects the distal end nearest the major surface among the composites, which does not intersect at least one cross-section of any abrasive composite among the array lying in such a plane.

In FIG. 1, a major front surface 11 is shown having a pair of opposite side edges 12 and 13, and a machine direction axis 14 extending parallel to the direction of said side edges, and a plurality of abrasive composites 15 fixed to at least the front major surface 11 of the backing. Each abrasive composite has a discernible precise shape defined by a discernible boundary 18. As the coated abrasive article is being used to abrade a surface, the composite breaks down revealing unused abrasive particles. Composite "s" is a shortest composite in the array while composites "t" are relatively taller thereto. For illustrative purposes, in FIG. 1, as well as FIGS. 10 and 11, a representative portion of the array is shown in enlarged views, but not the entire array across the lateral width direction of the abrasive article.

Figure 10:
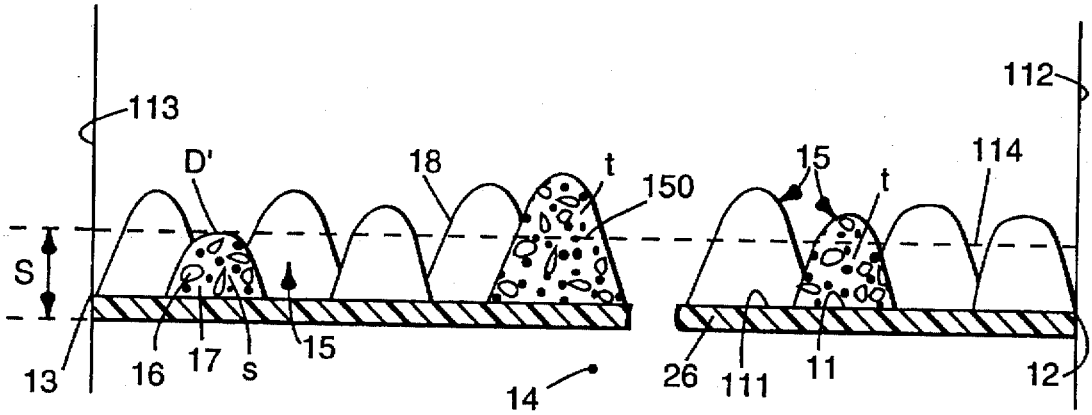
FIG. 10 is an end view in the direction 10—10 shown in FIG. 1.

FIG. 10 shows an end view of the abrasive article of FIG. 1 along the direction 10—10. The front major surface 11 lies in a first imaginary plane 111 extending parallel to backing 26, and the side edges 12, 13 of the abrasive article lie within second imaginary plane 112 and third imaginary plane 113, respectively, which extend perpendicular to plane 111. The fourth imaginary plane 114 extends parallel to and is spaced from the first imaginary plane 111 (major surface 11) on the side of the article bearing the composites. The fourth plane 114 cuts through a cross-section of the abrasive composites 15 at sites 150, including composite(s) "s" having distal end D' nearest the major surface 11 in vertical height, and taller composites "t". More than one composite can have the same height S with a distal end D' located nearest said major surface 11. For example, although not shown in FIG. 10, all of the composites can be formed with height S in this invention.

The abrasive composites 15 each comprise a plurality of abrasive particles 16 dispersed in the binder 17, such as shown in the composites "s" and "t". The abrasive composites 15 are "individual" in the sense that their distal ends, i.e. the terminus of each composite located vertically furthest from the major surface of the backing, are free from each other, i.e., are spaced and not interconnected with any adjacent composites.

Figure 11:
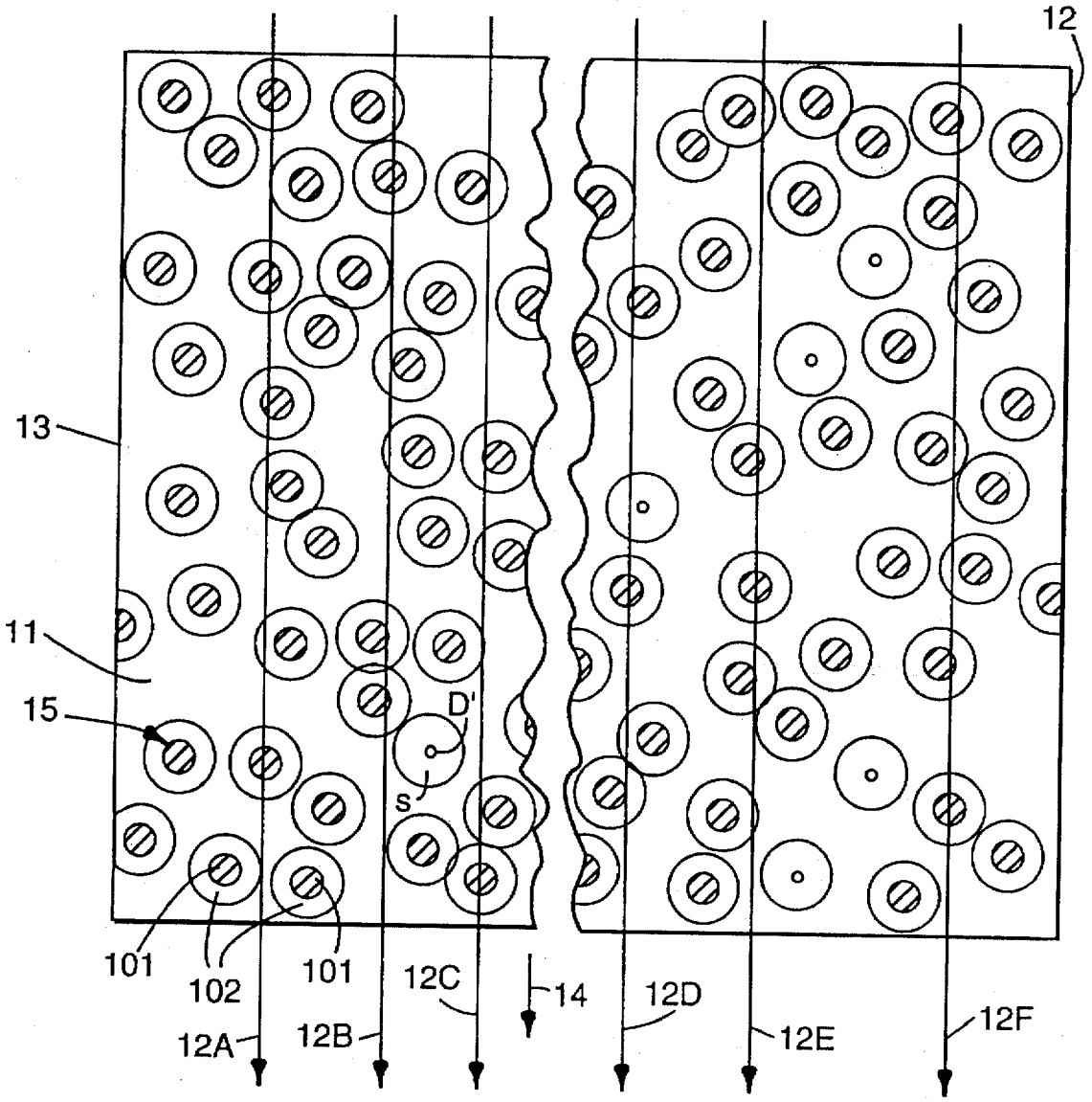
FIG. 11 is a cut view, in smaller overall scale somewhat, of the abrasive article of FIG. 10 showing cross-sections, by shading, of the slices of the abrasive composites lying within an imaginary plane spaced from the major surface.

FIG. 11 is a cut plan view of the abrasive article of FIG. 1, at the surface of imaginary plane 114, in somewhat reduced scale, to show a larger portion of the array of composites. The cross-sections of the abrasive composites which are cut or sliced by plane 114 are indicated as the shaded portions 101 while the profile of the base side of the abrasive composites that are in contact with major surface 11 are indicated as portions 102. It is understood that plane 114 is drawn at a spacing S from the major surface 11 equal to the shortest vertical height S of the composites, i.e., composite(s) "s", where the cross-section(s) of the shortest composite(s) "s" sliced by plane 114 essentially become a point(s).

In any event, no imaginary lines, such as 12A, 12B 12C, 12D, 12E or 12F and so forth, can be drawn along exposed plane 114 parallel to the machine direction axis 14 without intersecting at least one cross-sectional portion 101 of the abrasive composites lying in plane 114 oriented as defined above.

Figure 3:
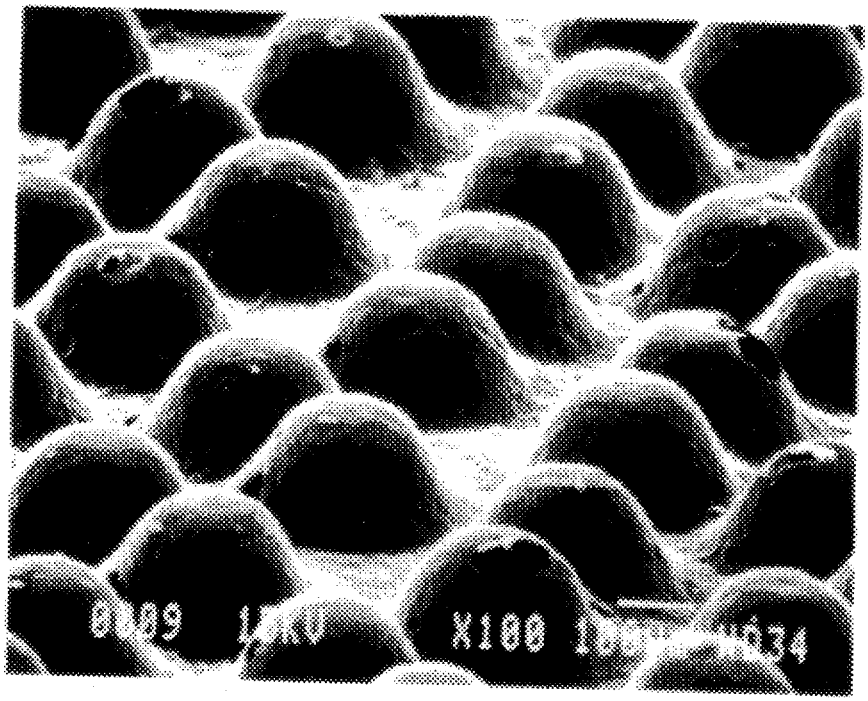
FIG. 3 is a Scanning Electron Microscope (SEM) photomicrograph taken at 100 magnification of the top surface of an abrasive article of the invention made by the General Procedure for Making the Abrasive Article described hereinafter.

The shape of the individual abrasive composites in the embodiment of the invention relating to truncated conical shapes with domes is shown in the SEM microphotograph in FIG. 3 at 100 times magnification. These composites are made by the General Procedure for Making the Abrasive Article described hereinafter. The density of the composites over the surface area is about 775 composites/square centimeter and the shapes have a height of about 160 micrometers.

Figure 4:
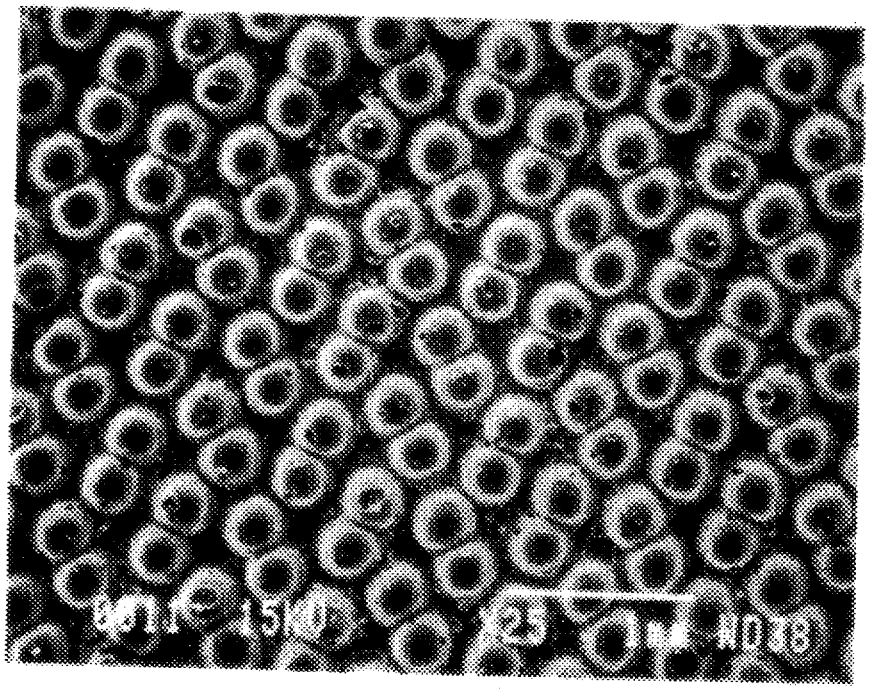
FIG. 4 is a SEM photomicrograph taken at 25 magnification in a plan view of an abrasive article of FIG. 3 showing the spacing of the composites.

As shown in FIG. 4, a top view of the abrasive composites in FIG. 3 at 25 times magnification, the composites are positioned on the major surface in an array such that the abrasive composites are not aligned on the major surface to form rectilinear columns or ridges of abrasive material. In FIG. 4, the darkened centers represent the largest cross-sectional profile of the rounded tip and the white circles represent the greatest outward extent of the base of the shapes.

It can be understood that where the abrasive article is intended to be adaptable to abrading in more than one machine direction, that the composites would be so arranged in an array to preclude the ability to draw an imaginary line in any and all of the intended directions of use without intersecting a cross-section of at least one composite lying in a plane parallel to major surface 11 and spaced at composite height S.

Figure 5:
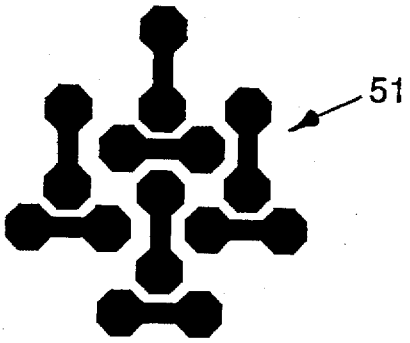
FIGS. 5 and 6 represent illustrative top views of various arrangements of dogbone-shaped composites in an array of the invention.
Figure 6:
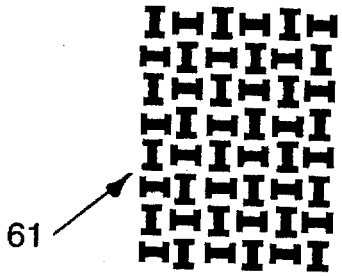
Figure 7:
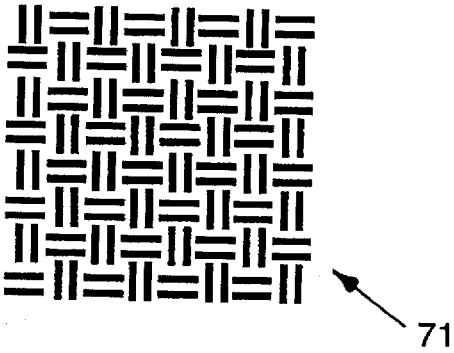
FIGS. 7 and 8 respectively represent illustrative top views of a cross-hatched arrangement and a herring bone arrangement of composites in arrays of the invention.
Figure 8:
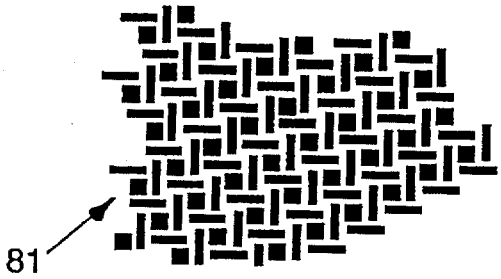

While the invention was demonstrated above by use of an array of frusto-conical abrasive shapes have domed ends, other arrays and shapes of abrasive composites also are contemplated within the scope of the invention. For instance, a "dogbone" array of composites of the invention can be used which comprises individual members of abrasive composite material where each are generally rectangular along its longitudinal axis but having enlarged ends as seen in a plan view, where these members are arranged perpendicularly in close noncontacting proximity to each other in the pattern. FIGS. 5 and 6 show exemplary dogbone patterns with patterns of abrasive composite material 51 and 61, respectively. A "cross-hatched" pattern has subsets of several parallel lines of abrasive composite material as seen in a plan view which closely approach perpendicularly but do not touch other such subsets. FIG. 7 shows an exemplary cross-hatched pattern of the invention with a pattern of abrasive composite material 71. The invention also contemplates the use of composite arrays in the configuration of a herring-bone pattern, such as depicted in FIG. 8, with a pattern of abrasive composite material 81. While the abrasive material segments in FIG. 8 are shown as approaching each other at approximately a ninety degree angle, the segments of abrasive material in the herring bone pattern can approach each other at a wide range of angles. It will be understood that these patterns shown in any of FIGS. 5, 6, 7 and 8 can be replicated as subarrays so as to provide an array which covers the entire surface area of the abrasive article.

Backing

A backing can be conveniently used in this invention to provide a surface for deploying the abrasive composites thereon, wherein such a backing has a front and back surface and can be any conventional abrasive backing. Examples of such include polymeric film, primed polymeric film, cloth including a dry cloth (greige cloth), paper, vulcanized fiber, nonwovens, and combinations thereof. The backing optionally may be a reinforced thermoplastic backing, such as described in U.S. Pat. No. 5,316,812 (Stout et al.) or an endless belt as described in PCT Publication WO/93/12911 published 8 Jul. 1993 (Benedict et al.). The backing may also contain a treatment or treatments to seal the backing and/or modify some physical properties of the backing. These treatments are well known in the art.

The backing may also have an attachment means on its back surface to secure the resulting coated abrasive to a support pad or back-up pad. This attachment means can be a pressure sensitive adhesive or a loop fabric for a hook and loop attachment. Alternatively, there may be a intermeshing attachment system, such as described in the U.S. Pat. No. 5,201,101 (Rouser et al.).

The back side of the abrasive article may also contain a slip resistant or frictional coating. An example of such a coating include compositions containing an inorganic particulate (e.g., calcium carbonate or quartz) dispersed in an adhesive. An antistatic coating comprising materials such as carbon black or vanadium oxide also may be included in the abrasive article, if desired.

Abrasive Composite a. Abrasive Particles

The abrasive particles typically have a particle size ranging from about 0.1 to 1000 micrometers, usually between about 0.1 to 400 micrometers, preferably between 0.1 to 100 micrometers. It is preferred that the abrasive particles have a Mohs' hardness of at least about 8, more preferably above 9. Examples of such abrasive particles include fused aluminum oxide (which includes brown aluminum oxide, heat treated aluminum oxide, and white aluminum oxide), ceramic aluminum oxide, green silicon carbide, silicon carbide, chromia, alumina zirconia, diamond, iron oxide, ceria, cubic boron nitride, boron carbide, garnet, and combinations thereof.

The term abrasive particles also encompasses when single abrasive particles are bonded together to form an abrasive agglomerate. Suitable abrasive agglomerates for this invention are further described in U.S. Pat. No. 4,311,489 (Kressner); U.S. Pat. No. 4,652,275 (Bloecher et al.) and U.S. Pat. No. 4,799,939 (Bloecher et al.).

It is also within the scope of this invention to have a surface coating on the abrasive particles. The surface coating may have many different functions. In some instances the surface coatings increase adhesion to the binder, alter the abrading characteristics of the abrasive particle, and the like. Examples of surface coatings include coupling agents, halide salts, metal oxides including silica, refractory metal nitrides, refractory metal carbides, and the like.

In the abrasive composite there may also be diluent particles. The particle size of these diluent particles may be on the same order of magnitude as the abrasive particles. Examples of such diluent particles include gypsum, marble, limestone, flint, silica, glass bubbles, glass beads, aluminum silicate, and the like.

b. Binder

The abrasive particles are dispersed in an organic binder to form the abrasive composite. The organic binder can be a thermoplastic binder, however, it is preferably a thermosetting binder. The binder is formed from a binder precursor. During the manufacture of the abrasive article, the thermosetting binder precursor is exposed to an energy source which aids in the initiation of the polymerization or curing process. Examples of energy sources include thermal energy and radiation energy which includes electron beam, ultraviolet light, and visible light. After this polymerization process, the binder precursor is converted into a solidified binder. Alternatively for a thermoplastic binder precursor, during the manufacture of the abrasive article the thermoplastic binder precursor is cooled to a degree that results in solidification of the binder precursor. Upon solidification of the binder precursor, the abrasive composite is formed.

The binder in the abrasive composite is generally also responsible for adhering the abrasive composite to the front surface of the backing. However, it some instances there may be an additional adhesive layer between the front surface of the backing and the abrasive composite.

There are two main classes of thermosetting resins, condensation curable and addition polymerized resins. The preferred binder precursors are addition polymerized resin because they are readily cured by exposure to radiation energy. Addition polymerized resins can polymerize through a cationic mechanism or a free radical mechanism. Depending upon the energy source that is utilized and the binder precursor chemistry, a curing agent, initiator, or catalyst is sometimes preferred to help initiate the polymerization.

Examples of typical binders precursors include phenolic resins, urea-formaldehyde resins, melamine formaldehyde resins, acrylated urethanes, acrylated epoxies, ethylenically unsaturated compounds, aminoplast derivatives having pendant unsaturated carbonyl groups, isocyanurate derivatives having at least one pendant acrylate group, isocyanate derivatives having at least one pendant acrylate group, vinyl ethers, epoxy resins, and mixtures and combinations thereof. The term acrylate encompasses acrylates and methacrylates.

Phenolic resins are widely used in abrasive article binders because of their thermal properties, availability, and cost. There are two types of phenolic resins, resole and novolac. Resole phenolic resins have a molar ratio of formaldehyde to phenol greater than or equal to one to one, typically between 1.5:1.0 to 3.0:1.0. Novolac resins have a molar ratio of formaldehyde to phenol of less than one to one. Examples of commercially available phenolic resins include those known by the tradenames "DUREZ" and "VARCUM" from Occidental Chemicals Corp.; "RESINOX" from Monsanto; "AEROFENE" from Ashland Chemical Co. and "AEROTAP" from Ashland Chemical Company.

Acrylated urethanes are diacrylate esters of hydroxy terminated NCO extended polyesters or polyethers. Examples of commercially available acrylated urethanes include "UVITHANE 782", available from Morton Thiokol Chemical, and "CMD 6600", "CMD 8400", and "CMD 8805", available from Radcure Specialties.

Acrylated epoxies are diacrylate esters of epoxy resins, such as the diacrylate esters of bisphenol A epoxy resin. Examples of commercially available acrylated epoxies include "CMD 3500", "CMD 3600", and "CMD 3700", available from Radcure Specialities.

Ethylenically unsaturated resins include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylol propane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyl adipamide. Still other nitrogen containing compounds include tris(2-acryloyl oxyethyl)-isocyanurate, 1,3,5-tri(2-methyacryloxyethyl)-s-triazine, acrylamide, methylacrylamide, N-methylacrylamide, N,N-dimethyl acrylamide, N-vinylpyrrolidone, and N-vinylpiperidone.

The aminoplast resins have at least one pendant alpha, beta-unsaturated carbonyl group per molecule or oligomer. These unsaturated carbonyl groups can be acrylate, methacrylate, or acrylamide type groups. Examples of such materials include N-hydroxymethyl -acrylamide, N,N'-oxydimethylene-bisacrylamide, ortho and para acrylamidomethylated phenol, acrylamidomethylated phenolic novolac, and combinations thereof. Examples of these materials are further described in U.S. Pat. No. 4,903,440 (Larson et al.) and U.S. Pat. No. 5,236,472 (Kirk et al.).

Isocyanurate derivatives having at least one pendant acrylate group and isocyanate derivatives having at least one pendant acrylate group are further described in U.S. Pat. No. 4,652,274 (Boettcher et al.). The preferred isocyanurate material is a triacrylate of tris(hydroxy ethyl) isocyanurate.

Epoxy resins have an oxirane and are polymerized by the ring opening. Such epoxide resins include monomeric epoxy resins and oligomeric epoxy resins. Examples of some preferred epoxy resins include 2,2-bis[4-(2,3-epoxypropoxy)phenyl propane] (diglycidyl ether of bisphenol A) and commercially available materials under the trade designation "EPON 828", "EPON 1004", and "EPON 1001F" available from Shell Chemical Co., "DER-331", "DER-332", and "DER-334" available from Dow Chemical Co. Other suitable epoxy resins include glycidyl ethers of phenol formaldehyde novolac (e.g., "DEN-431" and "DEN-428" available from Dow Chemical Co.).

The epoxy resins of the invention can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid. Other cationic curing agents include a salt having an organometallic complex cation and a halogen containing complex anion of a metal or metalloid which are further described in U.S. Pat. No. 4,751,138 (Tumey et al.)(column 6, line 65 to column 9, line 45). Another example is an organometallic salt and an onium salt is described in U.S. Pat. No. 4,985,340 (Palazzotto) (column 4 line 65 to column 14 line 50); European Patent Applications 306,161 and 306,162. Still other cationic curing agents include an ionic salt of an organometallic complex in which the metal is selected from the elements of Periodic Group IVB, VB, VIB, VIIB and VIIIB which is described in European Patent Application 109,851.

Regarding free radical curable resins, in some instances it is preferred that the abrasive slurry further comprise a free radical curing agent. However in the case of an electron beam energy source, the curing agent is not always required because the electron beam itself generates free radicals.

Examples of free radical thermal initiators include peroxides, e.g., benzoyl peroxide, azo compounds, benzophenones, and quinones. For either ultraviolet or visible light energy source, this curing agent is sometimes referred to as a photoinitiator. Examples of initiators, that when exposed to ultraviolet light generate a free radical source, include but are not limited to those selected from the group consisting of organic peroxides, azo compounds, quinones, benzophenones, nitroso compounds, acryl halides, hydrozones, mercapto compounds, pyrylium compounds, triacrylimidazoles, bisimidazoles, chloroalkytriazines, benzoin ethers, benzil ketals, thioxanthones, and acetophenone derivatives, and mixtures thereof. Examples of initiators that when exposed to visible radiation generate a free radical source, can be found in U.S. Pat. No. 4,735,632 (Oxman et al.), entitled Coated Abrasive Binder Containing Ternary Photoinitiator System. The preferred initiator for use with visible light is "IRGACURE 369" commercially available from Ciba Geigy Corporation.

The weight ratios between the abrasive particles and binder can range between 5 to 95 parts abrasive particles to 5 to 95 parts binder; more typically, 50 to 90 parts abrasive particles and 10 to 50 parts binder.

c. Additives

The abrasive slurry can further comprise optional additives, such as, for example, fillers (including grinding aids), fibers, lubricants, wetting agents, thixotropic materials, surfactants, pigments, dyes, antistatic agents, coupling agents, plasticizers, and suspending agents. The amounts of these materials are selected to provide the properties desired. The use of these can affect the erodability of the abrasive composite. In some instances an additive is purposely added to make the abrasive composite more erodable, thereby expelling dulled abrasive particles and exposing new abrasive particles.

Examples of useful fillers for this invention include: metal carbonates, such as calcium carbonate materials including chalk, calcite, marl, travertine, marble, limestone, calcium magnesium carbonate; sodium carbonate; magnesium carbonate; silica materials, such as quartz, glass beads, glass bubbles and glass fibers; silicates, such as talc, clays, montmorillonite, feldspar, mica, calcium silicate, calcium metasilicate, sodium aluminosilicate, sodium silicate; metal sulfates, such as calcium sulfate, barium sulfate, sodium sulfate, aluminum sodium sulfate, aluminum sulfate; gypsum; vermiculite; wood flour; aluminum trihydrate; carbon black; metal oxides, such as calcium oxide, lime, aluminum oxide, titanium oxide; and metal sulfites, such as calcium sulfite.

The term filler also encompasses materials that are known in the abrasive industry as grinding aids. A grinding aid is defined as particulate material that the addition of which has a significant effect on the chemical and physical processes of abrading which results in improved performance. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphtalene, pentachloronaphthalene; and polyvinyl chloride. Examples of halide salts include sodium chloride, potassium cryolite, sodium cryolite, ammonium cryolite, potassium tetrafluoroboate, sodium tetrafluoroborate, silicon fluorides, potassium chloride, magnesium chloride. Examples of metals include, tin, lead, bismuth, cobalt, antimony, cadmium, iron, and titanium. Other miscellaneous grinding aids include sulfur, organic sulfur compounds, graphite, and metallic sulfides.

Examples of antistatic agents include graphite, carbon black, vanadium oxide, humectants, and the like. These antistatic agents are disclosed in U.S. Pat. No. 5,061,294 (Harmer et al.); U.S. Pat. No. 5,137,542 (Buchanan et al.), and U.S. Pat. No. 5,203,884 (Buchanan et al.).

A coupling agent can provide an association bridge between the binder precursor and the filler particles or abrasive particles. Examples of coupling agents include silanes, titanates, and zircoaluminates. The abrasive slurry preferably contains anywhere from about 0.01 to 3% by weight coupling agent.

An example of a suspending agent is an amorphous silica particle having a surface area less than 150 meters square/gram that is commercially available from DeGussa Corp., under the trade name "OX-50".

Abrasive Composite Shape

Each individual abrasive composite has a precise shape associated with it. The precise shape is delimited by a distinct and discernible boundary, these terms being defined hereinabove. These distinct and discernible boundaries are readily visible and clear when the abrasive article of the invention is examined under a microscope such as a scanning electron microscope, e.g., as shown in FIG. 3. The distinct and discernible boundaries of each abrasive composite form the outline or contour of the precise shapes of the present invention. These boundaries separate and distinguish one individual abrasive composite from another.

In comparison, in an abrasive composite that does not have a precise shape, the boundaries and edges are not definitive, e.g., where the abrasive composite sags before completion of its curing. Thus, the expression "precisely-shaped", or the like, as used herein in describing the abrasive composites, also refers to abrasive composites having a shape that has been formed by curing or at least partially curing, or drying or partially drying, the curable binder of a flowable mixture of abrasive particles and curable binder while the mixture is both being borne on a backing and filling a cavity on the surface of a production tool. Such a precisely shaped abrasive composite would thus have precisely the same geometrical shape as that of the cavity. A plurality of such composites provide three-dimensional shapes that project outward from the surface of the backing in an inverse pattern to that presented by the production tool. Each composite is defined by a well-defined boundary or perimeter, the base portion of the boundary being the interface with the backing to which the precisely shaped composite is adhered. The remaining portion of the boundary is defined as the inverse shape of the cavity in the surface of the production tool in which the composite is cured. The entire outer surface of the composite is confined, either by the backing or by the cavity, during its formation. Suitable methods and techniques for forming precisely-shaped composites are disclosed in U.S. Pat. No. 5,152,917 (Pieper et al.).

An array of protrusions can be formed in a surface of a master tool, such as by match roll engraving, from which is produced a production tool having an array of cavity shapes which is the inverse shape of the predetermined array of abrasive composite shapes, which, in turn, can receive and mold an abrasive slurry described herein.

A flexible plastic production tooling also can be formed from the master by a method explained in U.S. patent application Ser. No. 08/004,929 (Spurgeon et al). As a result, the plastic production tooling has a surface which includes indentations having the inverse shape of the abrasive composites to be formed therewith. Exemplary techniques for making the array of abrasive composites will be described in greater detail hereinbelow.

Alternatively, the production tool could be formed directly by laser ablation of recesses into a metal or plastic surface where the recesses have shapes counter-corresponding to the ultimate abrasive composite shapes. This metal or plastic surface, as contoured by the laser, can be used to shape an abrasive slurry into the desired array of abrasive composite shapes. The recesses in the production tool shape the abrasive slurry until it cures and solidifies to a point where it can hold the shape and be separated from the production tool.

The abrasive composite shape of this invention can be any convenient shape. The shape can be a three-dimensional geometric shape such as a frusto-conical (truncated cone-flat top), a frusto-conical shape with a rounded, hemispherical or domed outer end, a frusto-conical shape (truncated cone) terminating at its outer end in a second smaller conical shape, cubic, prismatic (e.g., triangular, quadrilateral, hexagonal, and so forth), conical, cylindrical, pyramidal, truncated pyramidal (flat top), and the like. The geometrical shape of adjacent abrasive composites can be varied, e.g. frusto-conical next to truncated pyramidal. These geomtric shapes may have a cross sectional shape of a circle, triangle, square, diamond, pentagon, hexagon, oval, octagon and other polygons.

In one embodiment of the invention, the shapes of the abrasive composites all are provided with the same total height value, measured from the backing, in a range of from about 50 micrometers to about 1020 micrometers. In this situation, the plane drawn parallel to the major surface of the backing will intersect all the abrasive composites in points at their distal ends or cross-sectional slices for all spacings of the plane equal to or less than, respectively, the total height value of the composites. However, it is possible to vary the heights of the abrasive composites. In that situation, the plane drawn parallel to the major surface of the backing at a height spacing therefrom which is equal to or less than the shortest height value of the composites will intersect the composites taller than the shortest composite(s) in cross-sections instead of essentially at points, as shown in FIG. 10. It is desired that the plane 114 drawn parallel to the major surface is at a height equal to or, alternatively, at a height equal to or less than the shortest composite(s), to properly define the invention.

It is also within the scope of the invention to employ an array of abrasive composites having varying diameters at their base sides.

In general there are at least 5 individual abrasive composites per square centimeter. In some instances, there may be at least about 100 individual abrasive composites/square centimeter. More preferably, there are provided about 500 to 10,000 abrasive composites/square centimeter. There is no operational upper limit on the density of the abrasive composites; although, from a practical standpoint, at some point it may not be possible to increase the cavity density and/or form precisely shaped cavities in the surface of the production tooling used to make the array of abrasive composites. As for the lower limit, enough composites must be utilized to form an array which satisfies the aforestated overarching requirements of the invention and provides adequate grinding action.

Regarding the construction of the abrasive composites per se, and referring to FIG. 1 for illustrative purposes, the abrasive composite 15 has a boundary 18. The boundary or boundaries associated with the shape result in one abrasive composite distinguishable from an adjacent abrasive composite 19. Although not shown in FIG. 1, the base portions of the abrasive composites in the array can abutt with or be joined to an adjacent abrasive composite.

Figure 2:
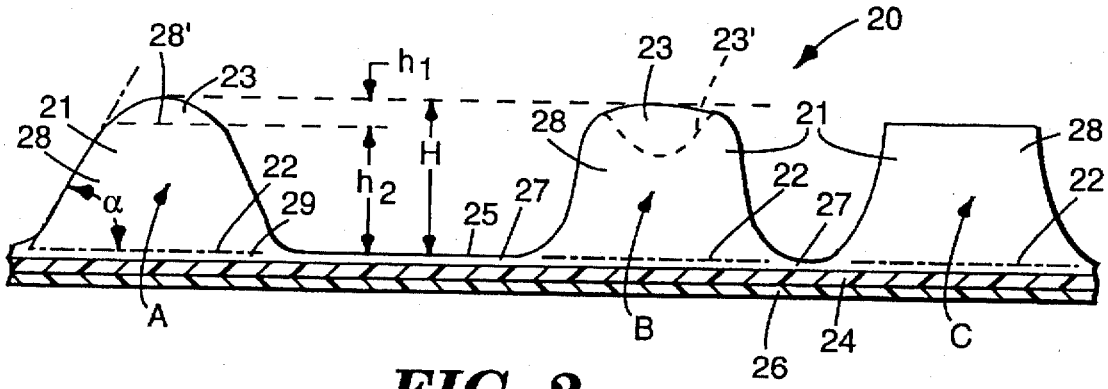
FIG. 2 is an enlarged end sectional view of an illustrative abrasive article of the invention showing different shapes of composites of the invention.

Referring to FIG. 2, the abrasive article of the invention comprises a backing 26 and several superposed layers bearing a plurality of abrasive composites 21. Again, the abrasive composites each comprise a plurality of abrasive particles that are dispersed in a binder. The abrasive composites 21 typically are bonded to a major surface 25 by a continuous land layer 27 of the abrasive composite material extending beneath and between the abrasive composites. Thus it is preferred that the backing be continuously covered with the abrasive composites and lands, i.e., the backing is not exposed. The abrasive composites and land 27 are formed at the same time from the same abrasive slurry when deposited upon a backing with production tools and techniques described herein. As a result, the three-dimensional abrasive composite structures 21 merge into the common monolithic base layer or land 27 at their lower edges forming fillets 29 therewith. Thus, the major surface of the land 27 (and abrasive article 20) is coplanar with the outer exposed surface area of land 27 extending between the three-dimensional abrasive composites 21. Heights of the composites, as indicated herein, are measured relative to this major surface. The land generally has a vertical thickness above the backing 26 (or backing 26 plus primer layer 24) of no greater than 50%, preferably between 1 to 25%, the vertical height H of the abrasive composites. Typically, the thickness of the land 27 will be less than about 10 micrometers where the height H of the abrasive composites is between 50 to 1020 micrometers.

As depicted in FIG. 2 for illustrative purposes, the abrasive composites A, B and C of abrasive article 20 represent various geometric shapes within the scope of the invention, in an end view. Each shape includes a frusto-conical (truncated conical) shape portion 28 attached at its lower end 22 to a major surface 25. An optional resinous presize coat 24, such as a phenolic-latex blend, can be applied to the backing 26 prior to forming the abrasive composites therein as means to modify some physical property of the backing including improving adhesion between the abrasive composites and the backing. The truncated cone portion 28 of the composites has a substantially symmetrical tapering down in cross-sectional area towards the outer second geometrical portion 23 of the composite shape; portions 23 and 28 being divided by imaginary line 28'. The outer portion 23 of the composite shape A is shown as a convexly rounded or hemispherical shape in FIG. 2.

The overall shape of composite A can be characterized as a so-called "gumdrop" shape. In one embodiment of the invention, all the abrasive composites have the overall geometrical shape of composite A. Composite B shows another embodiment where the rounded portion 23 is concave as shown by hidden hatched line 23'. Composite C is a truncated cone embodiment of the invention having no rounded tip. For instance, composites of shape A can be formed by methods described herein, and then the outer rounded portions of the abrasive article can be ground off (dressed) to leave truncated flat topped cones.

The angle $\alpha$ of the side walls of the truncated cone portion 21 is defined as the angle between the sidewalls and the major surface 25. Angle $\alpha$ can be in a range between about 30° to 90° in each of composites A, B, and C. Lower $\alpha$ values can decrease grinding performance as the three-dimensional shape of the composite is more flattened. Where $\alpha$ closely approaches or becomes 90°, the lower portions 28 of the shapes will change from truncated cones to a post-like shape. In one more particular embodiment, $\alpha$ values of 65° to 75° are employed. Also, the height $h_2$ of the truncated conical portion generally will represent about 50–95% of the overall vertical height H of the shape where a rounded portion 23 having vertical height $h_1$ is provided in composites A and B. In one particular embodiment, the height $h_2$ can represent about 80% of the overall H of Composites A or B.

Again, it is to be understood that the rounded shape of the outer end portion 23 of the composites can be eliminated to leave a flat top truncated cone, or contoured inwardly (cancavely) into the bulk of the frusto-conical portion as a depression to form an overall volcano-like shape as an alternative to being shaped convexly outwardly from the bulk of the frusto-conical portion of the composite. The concave indentation can be formed during the master tool process such as described herein.

Although it is ordinarily acceptable to use convexly rounded distal ends in the practice of the invention, there are instances contemplated where it may be desired for the tips of the composite to break off more quickly to provide an increased initial cutting ability. In those instances, the concavely or inwardly shaped distal ends may be helpful. The width and height of the composite shapes can be adjusted to provide the desired cut rate.

In general, this array of abrasive composites results in an abrasive article that has a relatively high rate of cut, a long life, but also results in a relatively fine surface finish on the workpiece being abraded with minimized scribing. Additionally, with this number of abrasive composites there is a relatively low unit force per each abrasive composite. In some instances, this can result in better, more consistent, breakdown of the abrasive composite.

It is also within the scope of this invention to have a combination of abrasive composites bonded to a backing in which some of adjacent abrasive composites abutt, while other adjacent abrasive composites have open spaces between them as long as the overarching requirement is met with respect to no line being drawable through the array of composites in a direction(s) of intended use of the abrasive article in service within an imaginary plane spaced parallel to the major surface that intersects the shortest distal end of the composites, that does not intersect at least one cross-section of the abrasive composites in such an imaginary plane.

Method of Making the Abrasive Article

Although additional details will be described later herein on the methods of making the abrasive article of the invention, in general, the first step in making the abrasive article is to prepare an abrasive slurry. The abrasive slurry is made by combining together by any suitable mixing technique the binder precursor, the abrasive particles, and the optional additives. Examples of mixing techniques include low shear and high shear mixing, with high shear mixing being preferred. Ultrasonic energy may also be utilized in combination with the mixing step to lower the abrasive slurry viscosity. Typically, the abrasive particles are gradually added into the binder precursor. The amount of air bubbles in the abrasive slurry can be minimized by pulling a vacuum during the mixing step, for example, by employing conventional vacuum-assisted methods and equipment.

In some instances it is preferred to heat, generally in the range of 30° to 70° C., the abrasive slurry to lower the viscosity. It is important the abrasive slurry have a rheology that coats well and in which the abrasive particles and other fillers do not settle.

If a thermosetting binder precursor is employed, the energy source for curing the binder precursor can be thermal energy or radiation energy depending upon the binder precursor chemistry. If a thermoplastic binder precursor is employed the thermoplastic is cooled such that it becomes solidified and the abrasive composite is formed. Other more detailed aspects of the method(s) to make the abrasive article of the invention will be described hereinbelow.

Production Tool

The production tool contains a plurality of cavities. These cavities are essentially the inverse shape of the abrasive composite desired and are responsible for generating the shape of the abrasive composites. The dimensions of the cavities are selected to provide the desired shape and dimensions of the abrasive composites. If the shape or dimensions of the cavities are not properly fabricated, the resulting production tool will not provide the desired dimensions for the abrasive composites.

The cavities can be present in a dotlike pattern with spaces between adjacent cavities, such as shown in FIG. 4, or the cavities can abutt against one another at their mouth portions; although the cavities must be configured such that the distal ends of the composites formed from the cavities must be free and unconnected to each in this invention.

The production tool can be a belt, a sheet, a continuous sheet or web, a coating roll such as a rotogravure roll, a sleeve mounted on a coating roll, or stamping die. The production tool can be composed of metal, (e.g., nickel), metal alloys (e.g., nickel alloys), plastic (e.g., polypropylene, an acrylic plastic), or any other conveniently formable material.

The thermoplastic production tool can be made by replication off a metal master roll tool. The metal master roll will have a surface topography that is the inverse pattern desired for the production tool. The metal master can be made by known matched roll engraving process techniques, knurling, and diamond turning. In the event of use of a metal master roll, a thermoplastic sheet material can be heated and optionally along with the metal master such that the thermoplastic material is embossed with the surface pattern presented by the metal master by pressing the two surfaces together. The thermoplastic can also be extruded or cast onto to the metal master. The thermoplastic material is cooled to solidify and produce the production tool. Examples of preferred thermoplastic production tool materials include polyester, polycarbonates, polyvinyl chloride, polypropylene, polyethylene, and combinations thereof.

If a thermoplastic production tool is utilized, then care must be taken not to generate excessive heat, particularly during the solidifying or curing of the binder precursor in the abrasive slurry step, that may distort the thermoplastic production tool.

The production tool also can be cast by extruding polymeric resin onto the drum and passing the extrudant between a nip roll and the drum, and then cooling the extrudant to form a production tool in sheet form having an array of cavities formed on the surface thereof in inverse correspondence to the surface protrusions presented by the master tool. This process can be conducted continuously to produce a polymeric tool of any desired length.

In an alternate aspect of the invention, the abrasive composites can be formed in a production tool, such as described herein, where the composites are liberated from the production tool cavities as individual composite shapes, and these loose composite shapes deposited upon and are bonded to a backing via a binder layer.

Energy Sources

When the abrasive slurry comprises a thermosetting binder precursor, the binder precursor is cured or polymerized. This polymerization is generally initiated upon exposure to an energy source. Examples of energy sources include thermal energy and radiation energy. The amount of energy depends upon several factors such as the binder precursor chemistry, the dimensions of the abrasive slurry, the amount and type of abrasive particles and the amount and type of the optional additives. For thermal energy, the temperature can range from about 30° to 150° C., generally between 40° to 120° C. The time can range from about 5 minutes to over 24 hours. The radiation energy sources include electron beam, ultraviolet light, or visible light. Electron beam radiation, which is also known as ionizing radiation, can be used at an energy level of about 0.1 to about 10 Mrad, preferably at an energy level of about 1 to about 10 Mrad. Ultraviolet radiation refers to non-particulate radiation having a wavelength within the range of about 200 to about 400 nanometers, preferably within the range of about 250 to 400 nanometers. It is preferred that 300 to 600 Watt/inch (120–240 Watt/cm) ultraviolet lights are used. Visible radiation refers to non-particulate radiation having a wavelength within the range of about 400 to about 800 nanometers, preferably in the range of about 400 to about 550 nanometers. It is preferred that 300 to 600 Watt/inch (120–240 Watt/cm) visible lights are used.

Figure 9:
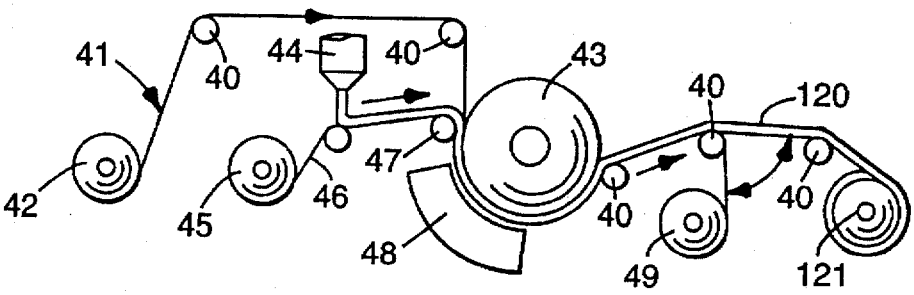
FIG. 9 is a side schematic view showing an apparatus used to make an abrasive article according to this invention.

One method to make the abrasive article of the invention is illustrated in FIG. 9. Backing 41 leaves an unwind station 42 and at the same time the production tool 46 leaves an unwind station 45. Cavities (not depicted) formed in the upper surface of production tool 46 are coated and filled with an abrasive slurry by means of coating station 44. Alternatively, coating station 44 can be relocated to deposit the slurry on backing 41 instead of the production tool before reaching drum 43 and the same ensuing steps are followed as used for coating the production tooling as described below. Either way, it is possible to heat, by means not shown, the abrasive slurry and/or subject the slurry to ultrasonics prior to coating to lower the viscosity. The coating station can be any conventional convenient coating means such as drop die coater, knife coater, curtain coater, vacuum die coater or a die coater. During coating the formation of air bubbles should be minimized. One suitable coating technique uses a vacuum die coater, which can be of the type such as described in U.S. Pat. Nos. 3,594,865; 4,959,265 and 5,077,870. After the production tool is coated, the backing and the abrasive slurry are brought into contact by any means such that the abrasive slurry wets the front surface of the backing. In FIG. 9, the abrasive slurry is brought into contact with the backing by means of contact nip roll 47, and contact nip roll 47 forces the resulting construction against support drum 43.

Next, any convenient form of energy 48 is transmitted into the abrasive slurry that is adequate to at least partially cure the binder precursor. The term partial cure is meant that the binder precursor is polymerized to such a state that the abrasive slurry does not flow from an inverted test tube. The binder precursor can be fully cured once it is removed from the production tool by any energy source. The production tool is rewound on mandrel 49 so that the production tool can be reused again. Additionally, abrasive article 120 is wound on mandrel 121. If the binder precursor is not fully cured, the binder precursor can then be fully cured by either time and/or exposure to an energy source. Additional steps to make the abrasive article according to this first method is further described in U.S. Pat. No. 5,152,917 (Pieper et al.) or U.S. Pat. No. 5,435,816 (Spurgeon et al.). Other guide rolls are used where convenient and are designated rolls 40.

Relative to this first method, it is preferred that the binder precursor is cured by radiation energy. The radiation energy can be transmitted through a transparent production tool or transparent backing to radiate the abrasive slurry where the production tool or backing does not appreciably absorb the radiation energy. Additionally, the radiation energy source should not appreciably degrade the production tool. It is preferred to use a thermoplastic production tool and ultraviolet or visible light.

As mentioned above, in a variation of this first method, the abrasive slurry can be coated onto the backing and not into the cavities of the production tool. The abrasive slurry coated backing is then brought into contact with the production tool such that the abrasive slurry flows into the cavities of the production tool. The remaining steps to make the abrasive article are the same as detailed above.

There is also a second method for making the abrasive article. The production tool is provided in the outer surface of a drum, e.g., as a sleeve which is secured around the circumference of a drum in separate sheet form (e.g., as a heat-shrunk nickel form) in any convenient manner. A backing leaves an unwind station and the abrasive slurry is coated into the cavities of the production tool by means of the coating station. The abrasive slurry can be coated onto the backing by any technique such as drop die coater, roll coater, knife coater, curtain coater, vacuum die coater, or a die coater. Alternatively, the abrasive slurry can be coated into the cavities of the production tool. Again, it is possible to heat the abrasive slurry and/or subject the slurry to ultrasonics prior to coating to lower the viscosity. During coating the formation of air bubbles should be minimized. Then, the backing and the production tool containing the abrasive slurry are brought into contact by a nip roll such that the abrasive slurry wets the front surface of the backing. Next, the binder precursor in the abrasive slurry is at least partially cured by exposure to an energy source sufficient such that the abrasive slurry is converted to an abrasive composite that holds its shape and is bonded or adhered to the backing. The resulting abrasive article is stripped and removed from the production tool at nip rolls and wound onto a rewind station. In this method, the energy source can be thermal energy or radiation energy. If the energy source is either ultraviolet light or visible light, the backing should be transparent to ultraviolet or visible light. An example of such a backing is polyester backing.

After the abrasive article is made, it can be flexed and/or humidified prior to converting. The abrasive article can be converted into any desired form such as a cone, endless belt, sheet, disc, etc. before the abrasive article is put into service.

Method of Refining a Workpiece Surface

Another embodiment of this invention pertains to a method of refining a workpiece surface. This method involves bringing into frictional contact the abrasive article of this invention with a workpiece. The term refine means that a portion of the workpiece is abraded away by the abrasive article. Additionally, the surface finish associated with the workpiece surface is reduced after this refining process. One typical surface finish measurement is Ra; Ra is the arithmetic surface finish generally measured in micro-inches or micrometers. The surface finish can be measured by a profilometer, such as that available under the trade designation Perthometer or Surtronic.

Workpiece

The workpiece can be any type of material such as metal, metal alloy, exotic metal alloy, ceramic, glass, wood, wood like material, composites, painted surface, plastic, reinforced plastic, stone, and combinations thereof. The workpiece may be flat or may have a shape or contour associated with it. Examples of workpieces include glass ophthalmic lenses, plastic ophthalmic lenses, glass television screens, metal automotive components, plastic components, particle board, cam shafts, crank shafts, furniture, turbine blades, painted automotive components, magnetic media, and the like.

Depending upon the application, the force at the abrading interface can range from about 0.1 kg to over 1000 kg. Generally this range is between 1 kg to 500 kg of force at the abrading interface. Also depending upon the application, there may be a liquid present during abrading. This liquid can be water and/or an organic compound. Examples of typical organic compounds include lubricants, oils, emulsified organic compounds, cutting fluids, soaps, or the like. These liquids may also contain other additives such as defoamers, degreasers, corrosion inhibitors, or the like.

The abrasive article of the invention can be used by hand or used in combination with a machine. At least one or both of the abrasive article and the workpiece is moved relative to the other in frictional contact. The abrasive article can be converted into a belt, tape rolls, disc, sheet, and the like. For belt applications, the two free ends of an abrasive sheet are joined together and a splice is formed. It is also within the scope of this invention to use a spliceless belt. Generally the endless abrasive belt traverses over at least one idler roll and a platen or contact wheel. The hardness of the platen or contact wheel is adjusted to obtain the desired rate of cut and workpiece surface finish. The abrasive belt speed ranges anywhere from about 150 to 5000 meters per minute, generally between 500 to 3000 meters per minute. Again this belt speed depends upon the desired cut rate and surface finish. The belt dimensions can range from about 5 mm to 1 meter wide and from about 5 cm to 10 meters long. Abrasive tapes are continuous lengths of the abrasive article. They can range in width from about 1 mm to 1 meter, generally between 5 mm to 25 cm. The abrasive tapes are usually unwound, traverse over a support pad that forces the tape against the workpiece and then rewound. The abrasive tapes can be continuously feed through the abrading interface or can be indexed. The abrasive disc, which also includes what is known in the abrasive art as "daisies", can range from about 50 mm to 1 meter in diameter. Typically abrasive discs are secured to a back-up pad by an attachment means. These abrasive discs can rotate between 100 to 20,000 revolutions per minute, typically between 1,000 to 15,000 revolutions per minute.

The features and advantages of the present invention will be further illustrated by the following non-limiting examples. All parts, percentages, ratios, and the like, in the examples are by weight unless otherwise indicated.

Experimental Procedure

The following abbreviations are used throughout:

TMPTA: trimethylol propane triacrylate;

PH2: 2-benzyl-2-N,N-dimethylamino-1-(4-morpholinophenyl)-1-butanone, commercially available from Ciba Geigy Corp. under the trade designation "IRGACURE 369";

ASF: amorphous silica filler, commercially available from DeGussa under the trade designation "OX-50";

FAO: fused heat treated aluminum oxide;

SCA: silane coupling agent, 3-methacryloxypropyltrimethoxysilane, commercially available from Union Carbide under the trade designation "A-174";

KBF4: potassium tetrafluoroborate.

General Procedure for Making the Abrasive Article

An abrasive slurry was prepared that contained 22 parts TMPTA, 0.2 part PH2, 0.9 part ASF, 17 parts KBF4, 0.9 part SCA and 59 parts of grade P-320 FAO. The slurry was mixed for 20 minutes at 1200 rpm using a high shear mixer.

The production tool was a continuous web made from a transparent polypropylene sheet material commercially available from Exxon under the trade designation "POLYPRO 3445". The production tool was embossed off of a knurled master roll by discharging a ribbon of the polypropylene in a molten state downward between the nip formed by the master tool and a smooth-surfaced back-up roll, and then cooled to retain the surface contour imparted from the master tool.

The master tool was made by known match roll engraving techniques. A roll tool having recesses therein corresponding in shape to the desired truncated cone shapes in the abrasive composites was rolled over the top of a steel roll or drum covered with a wax resist. The protuberances on the roll tool contacted and displaced wax on the drum into the areas corresponding to the recesses of the match roll. As the drum is rotated through an etch bath, the portions of the drum where wax was displaced were progressively etched away through each rotation of the drum to ultimately form a structured surface on the drum comprising an array of individual protuberances. The structured surface on the drum is conversely replicated in a surface of a production tool, which, in turn, was used to shape an abrasive slurry into abrasive composites having shapes corresponding to those protuberances left in the surface of the master drum tool.

In general, the production tool, as made from the master tool, contained an array of cavities that were inverted frusto-conical shapes having about 100 micrometer high truncated cones as lower portions and about 60 micrometer high convexly rounded domes as upper portions, and the three-dimensional cavity shapes had a constant overall depth of about 160 micrometers.

The pattern is premised on a repeating mosaic pattern of composite subarrays where no line could be drawn in the machine direction on the surface of the abrasive belt without intersecting the cross-section of least one composite in a plane extending parallel to the major surface and intersecting the shortest distal end of the composites, such as shown in FIG. 4.

The abrasive article was made by a method and arrangement generally depicted in FIG. 9. This process was a continuous process that operated at about 15.25 meters/minute. The backing was a J weight rayon backing that contained a dried latex/phenolic presize coating to seal the backing. The abrasive slurry was knife-coated onto the production tool at 15.2 meters/min (50 fpm) with a 76 micrometer knife gap (3 mil) without vacuum and about a 15 cm wide coating area onto the production tool. The nip pressure, such as exerted by roll 47 in FIG. 9, between the production tool and the backing was about 3.1×10 Pa. The energy source was two visible-light lamps, each which contained a V-bulb made by Fusion Systems, Co., which operated at 600 Watts/inch (240 Watt/cm). The partially cured slurry released very well from the production tool. After partially curing the abrasive slurry, the resulting coated abrasive was thermally cured for 12 hours at 240° F. (116° C.) to final cure the phenolic presize of the backing. There were about 775 abrasive composites per square centimeter formed on the surface of the backing having heights of about 160 micrometers.

Test Procedure I

The coated abrasive article was converted into 7.6 cm by 335 cm endless belt and tested on a constant load surface grinder. A pre-weighed, 304 stainless steel workpiece approximately 2.5 cm by 5 cm by 18 cm was mounted in a holder. The workpiece was positioned vertically, with the 2.5 cm by 18 cm face facing an approximately 36 cm diameter 65 Shore A durometer serrated rubber contact wheel with one on one lands over which was entrained the coated abrasive belt. The workpiece was then reciprocated vertically through an 18 cm path at the rate of 20 cycles per minute, while a spring loaded plunger urged the workpiece against the belt with a load of 4.5 kg (10 lbs) as the belt was driven at a surface speed of about 1400 meters per minute. After thirty seconds elapsed grinding time, the workpiece holder assembly was removed and re-weighed, the amount of stock removed calculated by subtracting the abraded weight from the original weight, and a new, pre-weighed workpiece and holder were mounted on the equipment.

Additionally, the surface finish Ra and the Rz of the workpiece was also measured and these procedures will be described below. The test endpoint was when the amount of steel removed in the sixty second interval was less than one third the value of the steel removed in the first sixty seconds of grinding a control belt or until the workpiece burned, i.e., became discolored.

Ra is a common measure of roughness used in the abrasives industry. Ra is defined as the arithmetic mean of the departures of the roughness profile from the mean line. Ra was measured with a profilometer probe, which was a diamond tipped stylus, at three locations and the arithmetic mean was calculated as the average of these three measurements. In general, the lower the Ra value was, the smoother or finer the workpiece surface finish. The results were recorded in micrometers. The profilometer used was a Perthen M4P.

Rz is a common measure of roughness used in the abrasive industry. Rz is defined as the Ten Point Roughness Height which is the average of the five greatest vertical peak-to-valley height differences within one cutoff length. Rz is measured with the same equipment as the Ra value. The results are recorded in micrometers. In general, the lower the Rz, the smoother the finish.

EXAMPLES

Example 1

To demonstrate the workability and advantageous effects of the abrasive articles representative of the invention, two samples of abrasive articles were both manufactured according to the "General Procedure for making the Abrasive Article" described herein to provide Samples A and B. The abrasive articles were tested according to Test Procedure I and the test results are summarized in Table 1A for Sample A results and Table 1B for Sample B results.

Three measurements were taken for each of Ra and Rz for each workpiece being refined by Sample A and B at several incipient and later times of interest during grinding, and the average value of these measurements are indicated in Tables 1A and 1B, respectively. The grinding time is indicated in minutes:seconds and the cut rate is quantified in grams that were abraded away for the period between each indicated time and the immediate prior time.

TABLE 1A

| Time | Cut | $Ra_1$ | $Ra_2$ | $Ra_3$ | Ra (ave) | $Rz_1$ | $Rz_2$ | $Rz_3$ | Rz (ave) |
|---|---|---|---|---|---|---|---|---|---|
| 00:30 | 3.1 | 24 | 25 | 28 | 25.7 | 213 | 201 | 227 | 213.7 |
| 01:00 | 5.3 | 39 | 36 | 47 | 40.7 | 298 | 280 | 304 | 294.0 |
| 02:00 | 17.3 | 39 | 44 | 44 | 42.3 | 299 | 292 | 307 | 299.3 |
| 03:00 | 16.5 | | | | | | | | |
| 04:00 | 14.0 | | | | | | | | |
| 05:00 | 12.4 | | | | | | | | |
| 06:00 | 11.4 | | | | | | | | |
| 07:00 | 9.8 | | | | | | | | |
| 08:00 | 8.9 | | | | | | | | |
| 09:00 | 7.3 | | | | | | | | |
| 10:00 | 7.6 | | | | | | | | |
| 11:00 | 6.9 | | | | | | | | |
| 12:00 | 6.6 | | | | | | | | |
| 13:00 | 6.2 | | | | | | | | |
| 14:00 | 5.7 | | | | | | | | |
| 15:00 | 5.4 | | | | | | | | |
| 16:00 | 4.9 | | | | | | | | |
| 17:00 | 5.0 | | | | | | | | |
| 18:00 | 4.9 | | | | | | | | |
| 19:00 | 4.7 | | | | | | | | |
| 20:00 | 4.6 | | | | | | | | |
| 21:00 | 4.2 | | | | | | | | |
| 22:00 | 4.4 | | | | | | | | |
| 23:00 | 3.9 | | | | | | | | |
| 24:00 | 3.1 | 14 | 17 | 19 | 16.7 | 114 | 137 | 128 | 126.3 |
| | 184.6 (total cut) | | | | | | | | |

TABLE 1B

| Time | Cut | $Ra_1$ | $Ra_2$ | $Ra_3$ | Ra (ave) | $Rz_1$ | $Rz_2$ | $Rz_3$ | Rz (ave) |
|---|---|---|---|---|---|---|---|---|---|
| 00:30 | 3.5 | 24 | 28 | 24 | 25.3 | 188 | 220 | 199 | 202.3 |
| 01:00 | 5.3 | 27 | 25 | 34 | 28.7 | 234 | 198 | 219 | 217.0 |
| 02:00 | 16.0 | 44 | 54 | 40 | 46.0 | 325 | 372 | 327 | 341.3 |
| 03:00 | 15.8 | | | | | | | | |
| 04:00 | 13.8 | | | | | | | | |
| 05:00 | 12.4 | | | | | | | | |
| 06:00 | 11.3 | | | | | | | | |
| 07:00 | 9.6 | | | | | | | | |
| 08:00 | 8.6 | | | | | | | | |
| 09:00 | 8.0 | | | | | | | | |
| 10:00 | 7.7 | | | | | | | | |
| 11:00 | 7.0 | | | | | | | | |
| 12:00 | 6.7 | | | | | | | | |
| 13:00 | 6.6 | | | | | | | | |
| 14:00 | 5.9 | | | | | | | | |
| 15:00 | 5.8 | | | | | | | | |
| 16:00 | 5.7 | | | | | | | | |
| 17:00 | 5.0 | | | | | | | | |
| 18:00 | 4.8 | | | | | | | | |
| 19:00 | 4.6 | | | | | | | | |
| 20:00 | 4.6 | | | | | | | | |
| 21:00 | 4.3 | | | | | | | | |
| 22:00 | 4.2 | | | | | | | | |
| 23:00 | 4.0 | | | | | | | | |
| 24:00 | 3.8 | 24 | 14 | 17 | 18.3 | 179 | 120 | 154 | 151.0 |
| | 184.7 (total cut) | | | | | | | | |

The above results show that the abrasive articles of the present invention demonstrated high cut and provided fine finish and without any scribing grooves being observed in the finished surface of the steel workpiece. Although the initial cut of the inventive abrasive article was not aggressive at 4.5 kg of pressure, as soon as the rounded tips of the composites began to wear away within about 2 minutes the cut rate became excellent to provide a total cut of about 185 grams at 24 minutes.

Example 2

An abrasive article was manufactured according to the "General Procedure for making the Abrasive Article" described herein, and the same as used in Example 1, to provide Sample C. However, the abrasive article of Sample C was tested according to Test Procedure I except at about 9 kg of pressure and the test results are summarized in Table 2. Three measurements were taken for each of Ra and Rz for each workpiece being refined by Sample C at several incipient and a later time of interest during grinding, and the average values thereof are indicated in Table 2.

The grinding time is indicated in minutes:seconds and the cut rate is quantified in grams that were abraded away for the period between each indicated time and the immediate prior time.

TABLE 2

| Time | Cut | $Ra_1$ | $Ra_2$ | $Ra_3$ | Ra (ave) | $Rz_1$ | $Rz_2$ | $Rz_3$ | Rz (ave) |
|---|---|---|---|---|---|---|---|---|---|
| 00:30 | 25.8 | 34 | 36 | 31 | 33.7 | 254 | 288 | 218 | 253.3 |
| 01:00 | 24.5 | 34 | 31 | 29 | 31.3 | 227 | 273 | 232 | 244.0 |
| 02:00 | 20.0 | 25 | 23 | 26 | 24.5 | 197 | 176 | 220 | 197.7 |
| 03:00 | 16.0 | | | | | | | | |
| 04:00 | 13.1 | | | | | | | | |
| 05:00 | 11.2 | | | | | | | | |
| 06:00 | 10.8 | | | | | | | | |
| | 121.4 (total cut) | | | | | | | | |

No scribing was observed in the finished surface of the steel workpiece. The results show that at 9 kg of intitial pressure, the tips of the composites began to cut immediately and a total cut of about 121 grams was achieved within only about 6 minutes.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An abrasive article comprising a sheet-like structure including:

(a) a major surface extending within a first imaginary plane with a plurality of individual three-dimensional abrasive composites deployed in fixed positions thereto in an array, each of said composites comprising abrasive particles dispersed in a binder and having a substantially precise shape and a distal end extending farthest from said major surface, and wherein said plurality of composites each include cross-sections coplanar and parallel to said first imaginary plane and include at least one composite having a nearest distal end spaced nearest to said major surface, as measured in a direction perpendicular to said first imaginary plane; and (b) wherein a fourth imaginary plane extends parallel to and is spaced from said first imaginary plane that intersects said nearest distal end spaced nearest to said major surface, wherein any imaginary line drawn within said fourth imaginary plane intersects at least one said cross-section among said abrasive composites in said array.

2. The abrasive article of claim 1, wherein said composites comprise a geometrical shape having a first portion in contact with said major surface and a second portion as an outer end, where said first portion comprises a frusto-conical shape and said second portion comprises a rounded shape.

3. The abrasive article of claim 1, wherein said sheet-like structure comprises a discrete sheet completely bounded by edges.

4. The abrasive article of claim 1, wherein said sheet-like structure comprises an endless belt configuration.

5. The abrasive article of claim 1, wherein each of said plurality of abrasive composites is free from contact with any other said composite.

6. The abrasive article of claim 1, wherein each said nearest distal end of said composites is vertically spaced from said major surface a distance of about 50 micrometers to about 1020 micrometers.

7. The abrasive article of claim 1, wherein each said nearest distal end of said composites is vertically spaced substantially the same distance from said major surface.

8. The abrasive article of claim 1, wherein said abrasive composites are fixed on said major surface in a density of about 100 to about 10,000 abrasive composites/$cm^2$.

9. An abrasive article comprising a sheet-like structure including a major surface with a plurality of individual three-dimensional abrasive composites deployed in fixed positions thereto, each of said composites comprising abrasive particles dispersed in a binder and having a substantially precise shape, wherein said composites have a three-dimensional geometric shape comprising a frusto-conical shape in contact with said major surface and a rounded shape at a distal end extending farthest from said major surface, at least one composite having a nearest distal end spaced nearest to said major surface as measured perpendicular to said major surface such that any imaginary line drawn in a plane that extends parallel to said major surface and intersects said nearest distal end will intersect at least one of said composites.

10. The abrasive article of claim 9, wherein said rounded shape is convex.

11. The abrasive article of claim 9, wherein said rounded shape is concave.

12. The abrasive article of claim 9, wherein each said abrasive composite has a total vertical height from said major surface comprising a first vertical height of said frusto-conical shape and a second vertical height of said rounded shape, where said first vertical height comprises 50 to 95% of said total vertical height of said abrasive composite.

13. The abrasive article of claim 9, wherein said frusto-conical shape comprises sidewalls forming an angle with said major surface of about 30° to about 90°.

14. A method for manufacturing an abrasive article comprising the steps of:

(a) preparing an abrasive slurry wherein the abrasive slurry comprises a plurality of abrasive particles dispersed in a binder precursor;

(b) providing (i) a backing having a front major surface with a machine direction axis and a pair of opposite side edges, each said side edge being parallel to said machine direction axis and each side edge being respectively within a second and third imaginary plane each of which extends perpendicular to said front surface, and (ii) a production tool having a major surface bounded by parallel opposing side edges and a plurality of cavities each defined by a walled recess having an opening at said major surface, wherein each cavity comprises a precise shape defined by a distinct and discernible boundary which includes specific dimensions, whereby any imaginary line drawn to traverse said major surface of said production tool in a direction parallel to said opposing side edges of said production tool intersects at least one cavity opening among said plurality of cavities;

(c) providing a means to apply said abrasive slurry into and at least filling a plurality of said cavities of said production tool;

(d) contacting said front major surface of said backing with said production tool such that the abrasive slurry wets said front major surface;

(e) solidifying the binder precursor to form a binder, whereupon solidification the abrasive slurry is converted into a plurality of abrasive composites; and (f) separating said production tool from said front major surface after said solidifying to provide a plurality of individual three-dimensional abrasive composites attached in an array to said front major surface, each of said composites comprising abrasive particles dispersed in a binder and having a substantially precise shape and a distal end spaced from said major surface, and wherein said plurality of composites each include cross-sections coplanar and parallel to said first imaginary plane and include at least one composite having a distal end spaced nearest to said major surface, as measured in a direction perpendicular to said first imaginary plane, and wherein a fourth imaginary plane extends parallel to and is spaced from said first imaginary plane that intersects said nearest distal end, wherein any imaginary line drawn within said fourth imaginary plane in a direction parallel to said machine direction axis and between said second and third imaginary planes intersects at least one said cross-section among said abrasive composites.

15. A method of refining a workpiece with an abrasive article comprising the steps of:

(a) bringing into frictional contact a workpiece surface having a surface finish and an abrasive article, wherein said abrasive article comprises a sheet-like structure, including:

(i) a major surface extending within a first imaginary plane with a plurality of individual three-dimensional abrasive composites deployed in fixed position thereto to form an array, each of said composites comprising abrasive particles dispersed in a binder and each have a substantially precise shape and a distal end, and wherein said plurality of composites each include cross-sections coplanar and parallel to said first imaginary plane include at least one composite having a distal end spaced nearest to said major surface, as measured in a direction perpendicular to said first imaginary plane;

(ii) a machine direction axis and opposite side edges, each side edge being parallel to said machine direction axis and each side edge being respectively within a second and third imaginary plane each of which extends perpendicular to said major surface; and (iii) a fourth imaginary plane extending parallel to and is spaced from said first imaginary plane that intersects said nearest distal end, wherein any imaginary line drawn within said fourth imaginary plane in a direction parallel to said machine direction axis and between said second and third imaginary planes intersects at least one said cross-section among said abrasive composites in said array; and (b) moving at least one of said abrasive article or said workpiece surface in frictional contact relative to the other in a direction parallel to said machine direction axis in a manner whereby the surface finish of said workpiece surface is reduced.

16. A method of manufacturing an abrasive article comprising the steps of:

(a) preparing an abrasive slurry wherein the abrasive slurry comprises a plurality of abrasive particles dispersed in a binder precursor;

(b) providing (i) a backing having a front major surface, and (ii) a production tool having a major surface comprising a plurality of cavities each defined by a walled recess having an opening at said major surface, wherein at least one cavity comprises a frusto-conical shape with a rounded distal end, whereby any imaginary line drawn to traverse said major surface of said production tool intersects at least one cavity opening among said plurality of cavities;

(c) providing a means to apply said abrasive slurry into and at least filling a plurality of said cavities of said production tool;

(d) contacting said front major surface of said backing with said production tool such that the abrasive slurry wets said front major surface;

(e) solidifying the binder precursor to form a binder, whereupon the abrasive slurry is converted into a plurality of abrasive composites; and (f) separating said production tool from said front major surface of said backing after said solidifying to provide a plurality of individual three-dimensional abrasive composites attached to said front major surface, each of said composites having a substantially precise frusto-conical shape and a rounded distal end spaced from said major surface, and wherein said plurality of composites each include cross-sections coplanar and parallel to said front major surface and include at least one composite having a distal end spaced nearest to said major surface, as measured in a direction perpendicular to said front major surface, and wherein an imaginary plane extends parallel to and is spaced from said front major surface that intersects said nearest distal end, wherein any imaginary line drawn with said imaginary plane intersects at least one said cross-section.

* * * * *

UNITED STATES PATENT AND TRADEMARK OFFICE

CERTIFICATE OF CORRECTION

PATENT NO. : 5,681,217
DATED : October 28, 1997
INVENTOR(S) : Timothy L. Hoopman and Scott R. Culler It is certified that error appears in the above-identified patent and that said Letters Patent is hereby corrected as shown below:

Column 7,
Line 15, "ability to to draw" should be -- ability to draw --

Column 12,
Line 43, "However, it some" should be -- However, in some --

Column 18,
Line 40, "(cancavely)" should be -- (concavely) --

Signed and Sealed this

Thirtieth Day of April, 2002

*Attest:*

*Attesting Officer*

JAMES E. ROGAN
*Director of the United States Patent and Trademark Office*